United States Patent [19]

Morganroth

[11] 4,209,027

[45] Jun. 24, 1980

[54] HAIR TREATMENT DEVICES AND PACKAGING THEREFOR

[76] Inventor: Shila Morganroth, 1225 Waterbury Rd., Highland, Mich. 48031

[21] Appl. No.: 481,695

[22] Filed: Jun. 21, 1974

[51] Int. Cl.[2] ..... A45D 1/00

[52] U.S. Cl. ..... 132/9

[58] Field of Search ..... 132/9, 11, 85, 116, 132/120; 401/31, 36; 128/67, 403; 222/533, 536, 215; 137/625.12

[56] References Cited

U.S. PATENT DOCUMENTS

| | | | |
|---|---|---|---|
| 873,550 | 12/1907 | Hudson | 132/85 |
| 2,009,773 | 7/1935 | Heflin | 128/67 |
| 2,184,678 | 12/1939 | Mueller | 137/625.12 |
| 2,228,213 | 1/1941 | Hillsberry | 132/9 |
| 2,617,431 | 11/1952 | Gaspari | 132/120 |
| 2,794,440 | 6/1957 | Levie | 132/7 |
| 2,819,723 | 1/1958 | Meyer | 132/116 |
| 2,936,934 | 5/1960 | Kubiliunas | 222/484 |
| 2,959,800 | 11/1960 | Bischoff | 401/16 |
| 2,964,770 | 12/1960 | Lerner et al. | 15/136 |
| 2,979,238 | 4/1961 | Bramming | 222/484 |
| 3,167,806 | 2/1965 | Hogan | 132/85 |
| 3,175,558 | 3/1965 | Caillouette et al. | 128/403 |
| 3,283,967 | 11/1966 | Akers | 222/536 |
| 3,320,962 | 5/1967 | Moriber et al. | 401/31 |
| 3,429,642 | 2/1969 | Underwood | 401/16 |
| 3,461,868 | 8/1969 | Palich | 222/215 |
| 3,570,499 | 3/1971 | Ruta | 132/9 |

FOREIGN PATENT DOCUMENTS

| | | | |
|---|---|---|---|
| 381584 | 9/1923 | Fed. Rep. of Germany | 401/36 |

*Primary Examiner*—G. E. McNeill

*Attorney, Agent, or Firm*—George H. Mortimer

[57] ABSTRACT

A hair treatment device comprising an elongated spreading means, a parting tip extending outwardly in the same general direction as the long dimension of the spreading means and a handle for manipulating the device to form tresses and then to spread liquid thereon with good control when moved transversely of the axis of the tip and spreading means. The handle may be an integral part of the device but preferably is a separable squeeze bottle to dispense hair treating liquids through a passageway in the device connecting the bottle to at least one exterior discharge orifice. The discharge orifice may be in the tip, the spreading device or both and the device may include a valve for directing liquid selectively to one or the other orifice, or both, or for blocking the passageway to both, in which case a pressure relief valve may be provided. Various forms of spreading devices may be provided including means forming an elongated slit, or means adapted to penetrate between the hairs of a tress, such as a brush, comb, grooved roller, terry cloth, cotton, and the like. Means to correlate the area of discharge passageways with the viscosity of liquids may include tapered passageways through snipable tips, replacement tips or ends thereof, pressure control plates and the like. Dual compartment containers and hair treatment devices therefor are provided. The hair treating liquids may be mixed in the squeeze bottles, in separate manipulatable containers adapted to be placed in or emptied into squeeze bottles and which may serve as packages for shipping and storing reactive materials that are kept separate until mixed just prior to use.

13 Claims, 61 Drawing Figures

FIG. 1
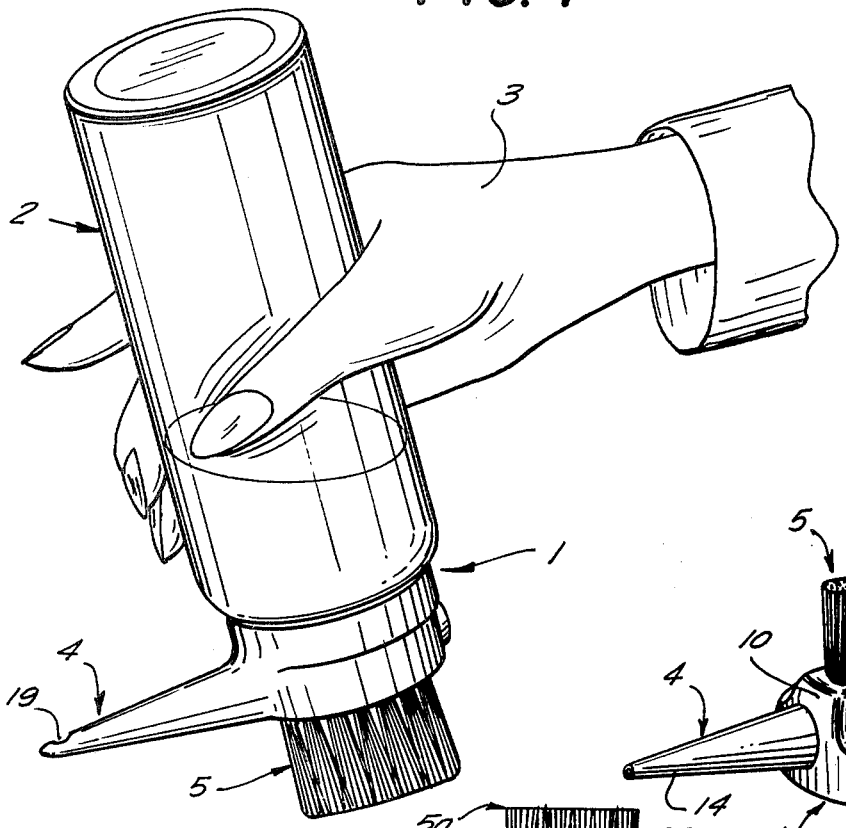
FIG. 3
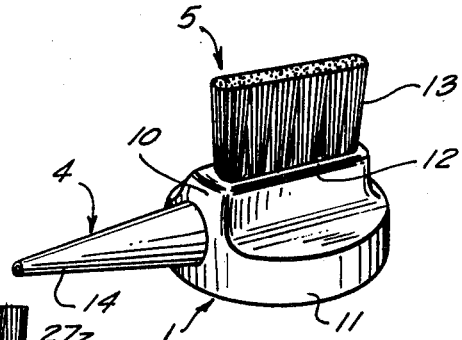
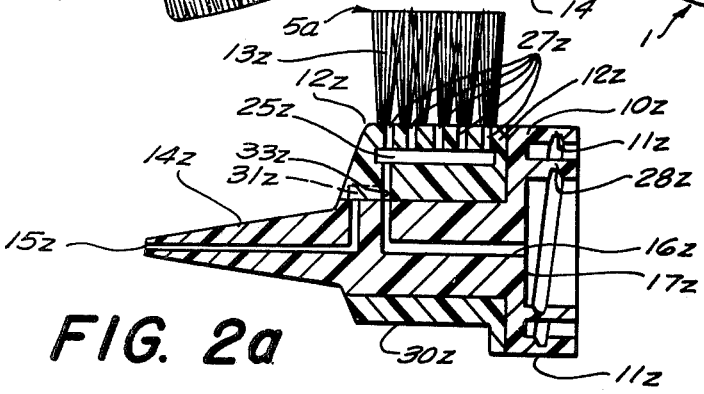
FIG. 2a
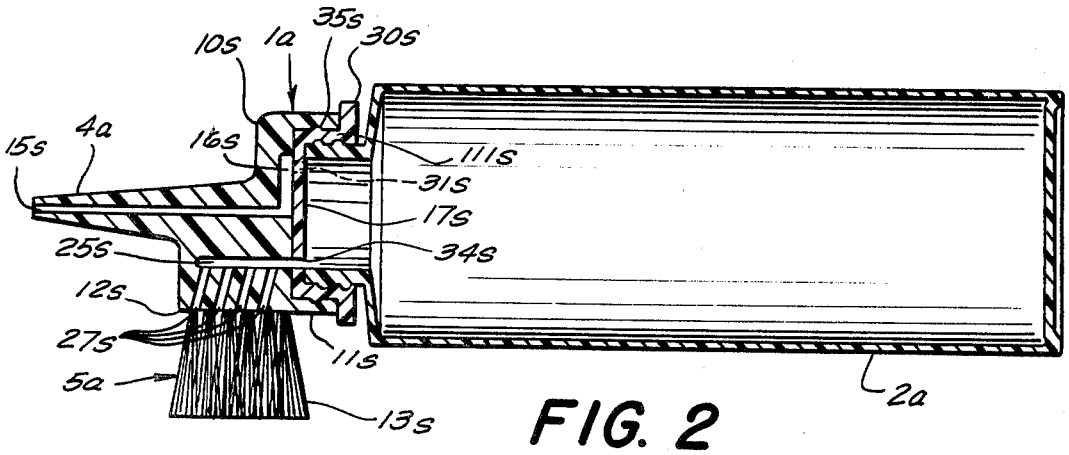
FIG. 2

FIG. 4
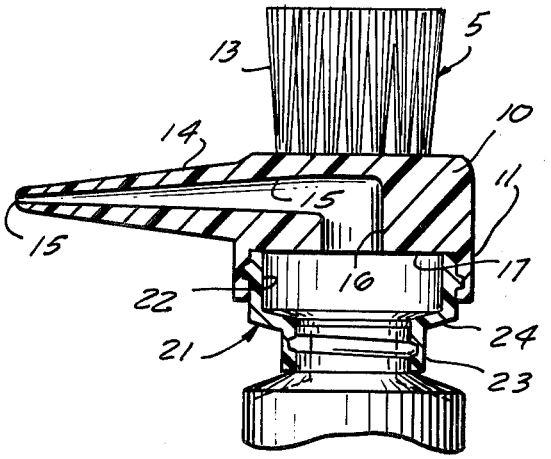
FIG. 5
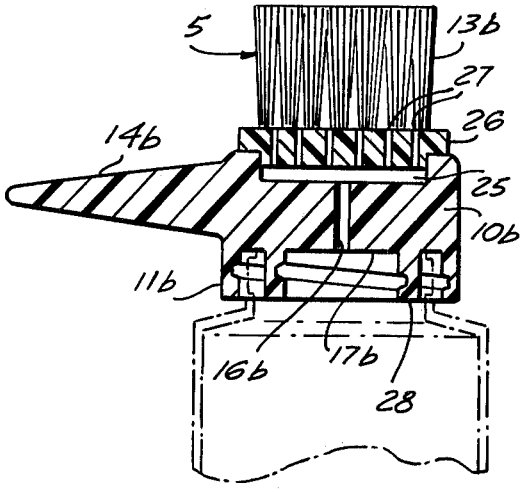
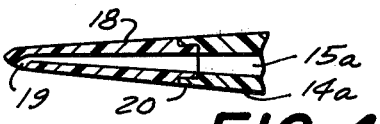
FIG. 4a
FIG. 6
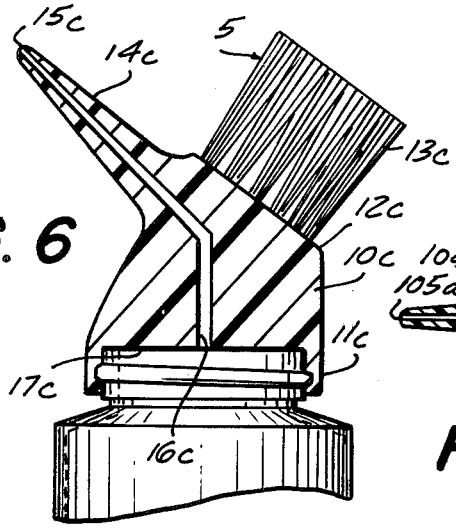
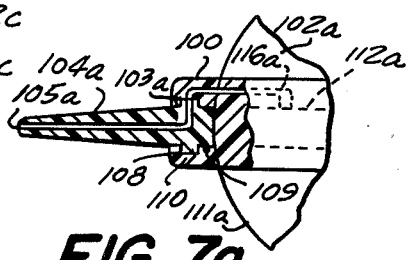
FIG. 7a
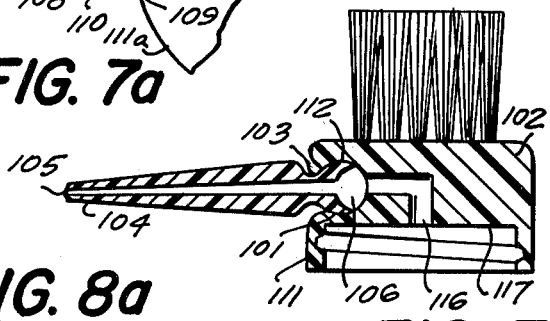
FIG. 7
FIG. 8
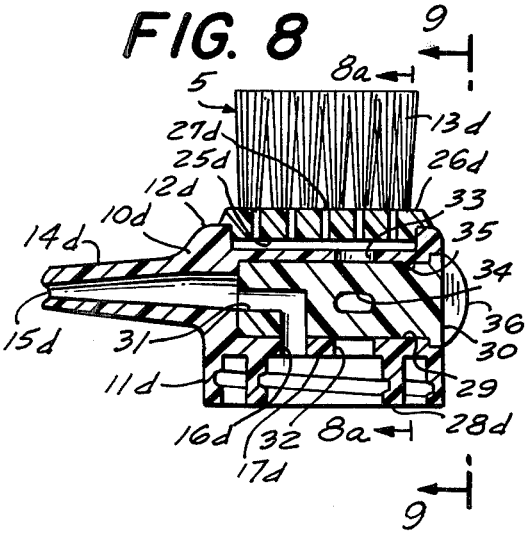
FIG. 8a
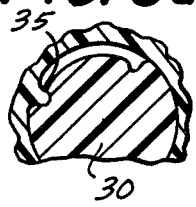
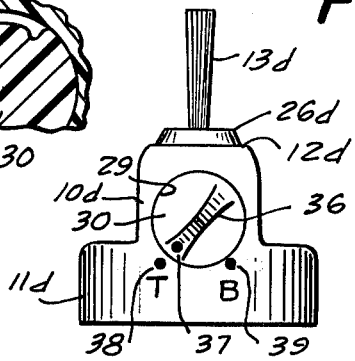
FIG. 9

FIG. 10
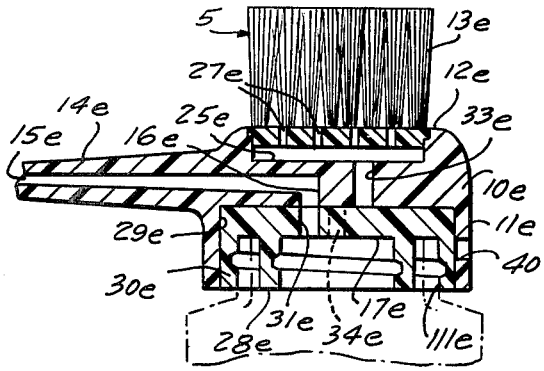
FIG. 11
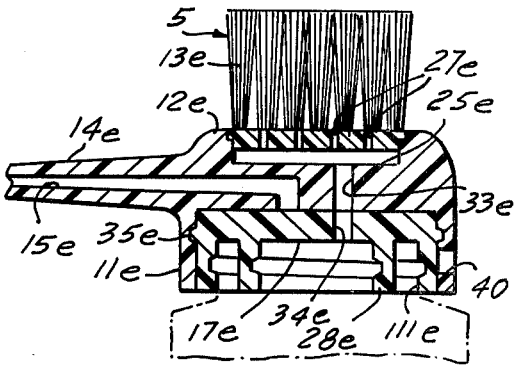
FIG. 12
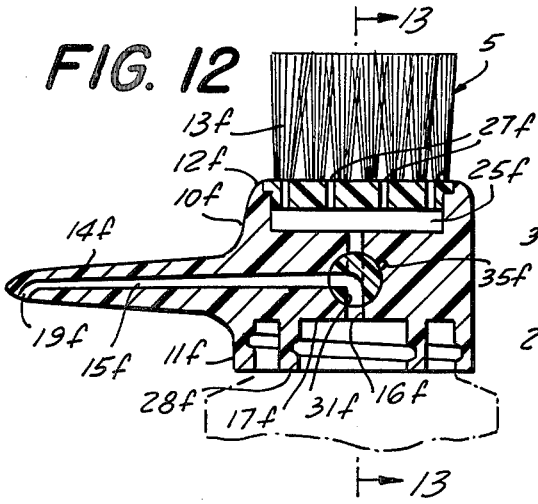
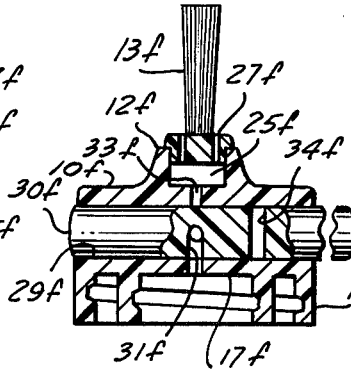
FIG. 13
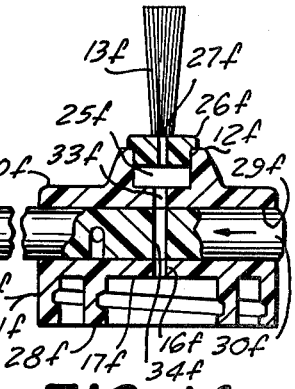
FIG. 14
FIG. 15
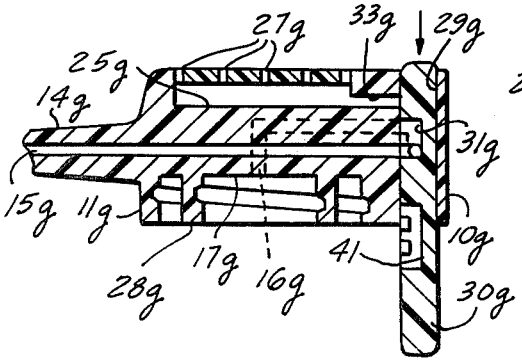
FIG. 16
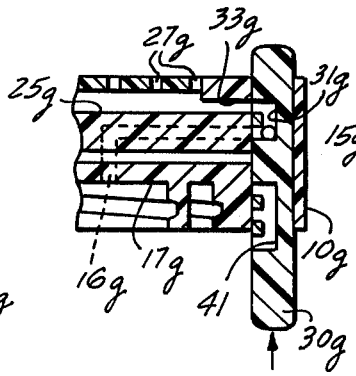
FIG. 17
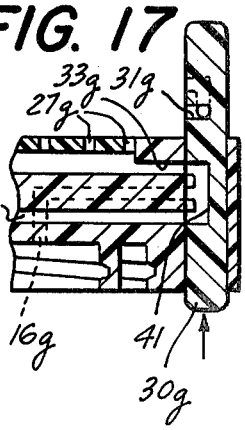

FIG. 23
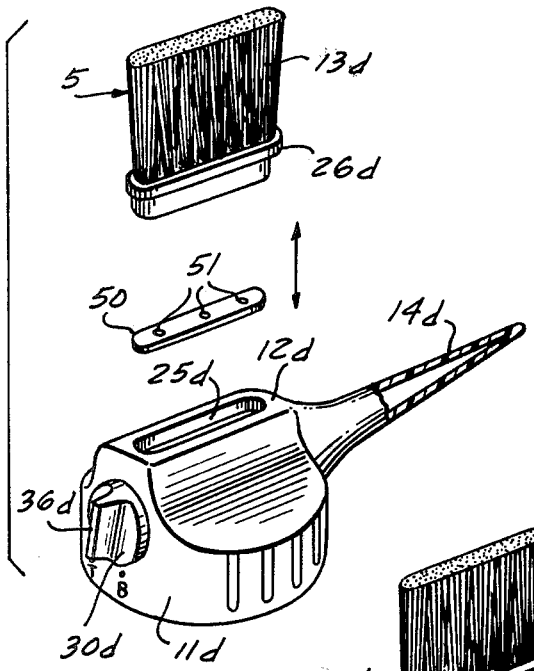
FIG. 25
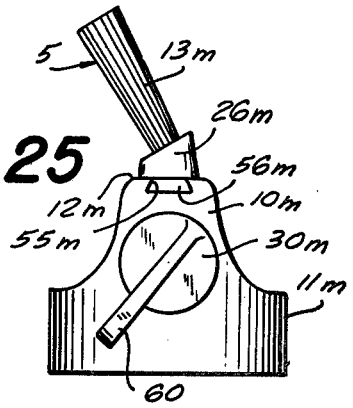
FIG. 24
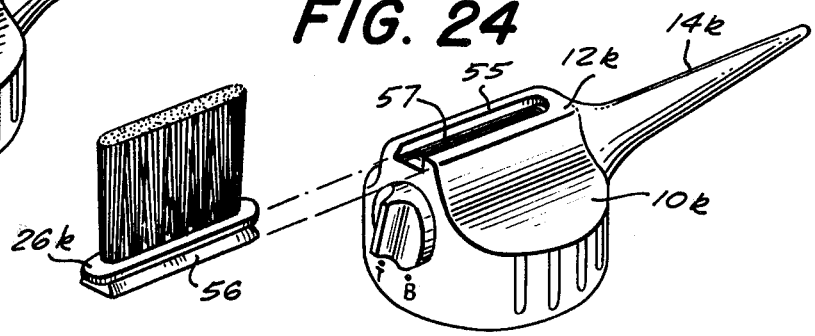
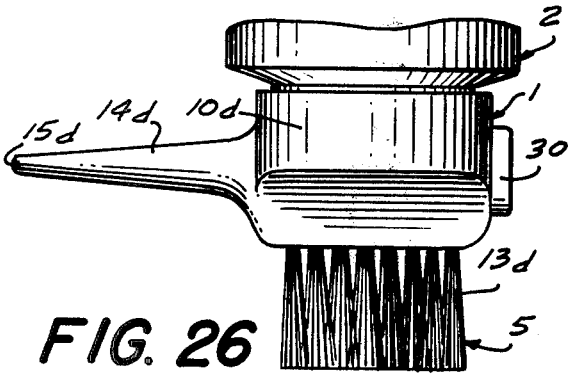
FIG. 26
FIG. 27
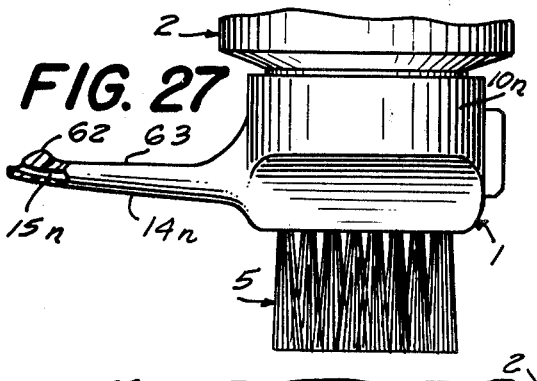
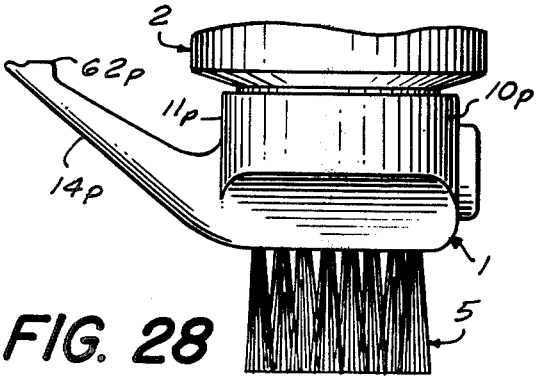
FIG. 28
FIG. 29
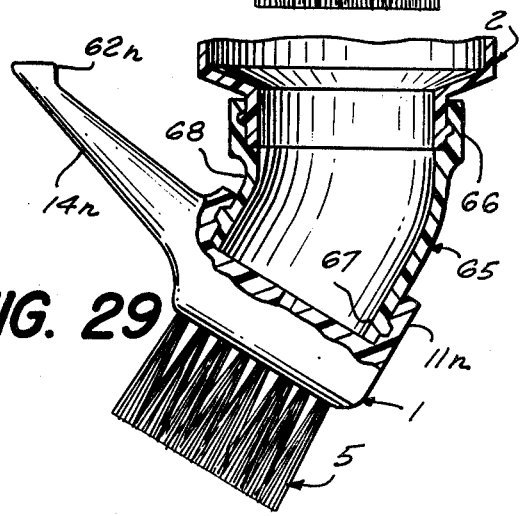

FIG. 35
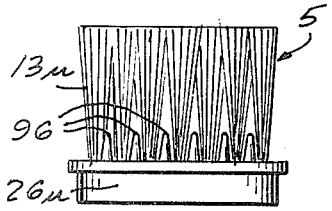
FIG. 36
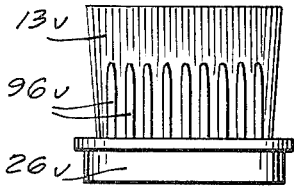
FIG. 37
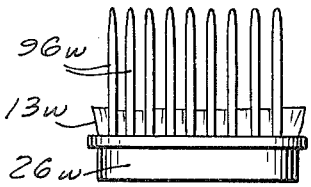
FIG. 38
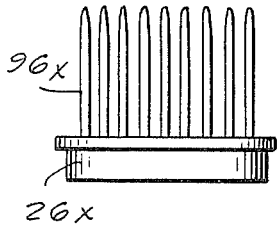
FIG. 34
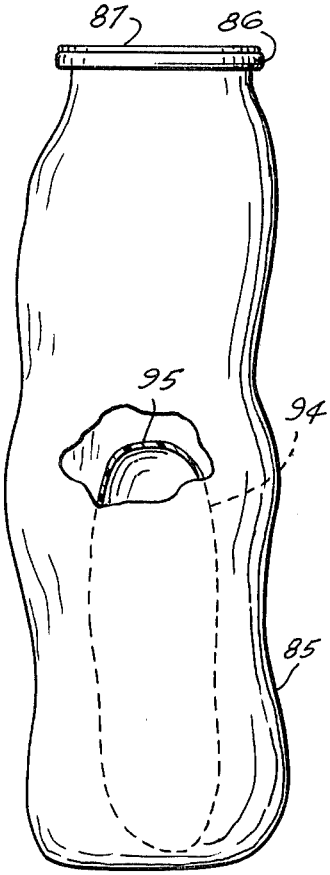
FIG. 39
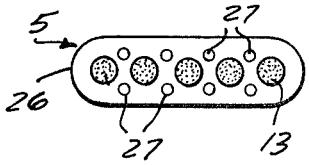
FIG. 40
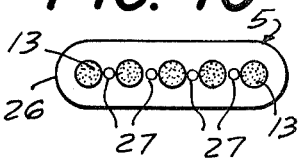
FIG. 41
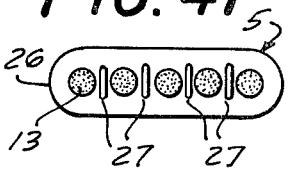
FIG. 42
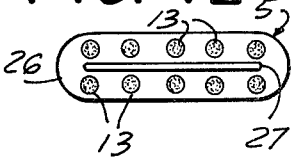
FIG. 43
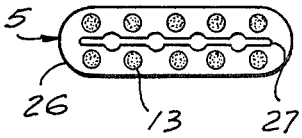
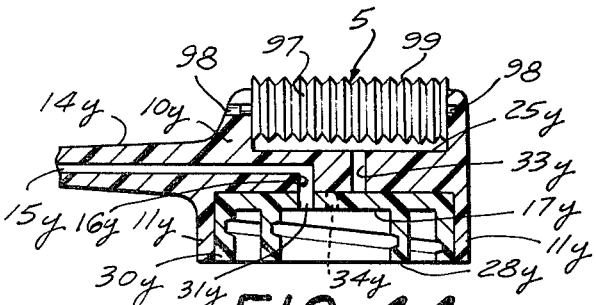
FIG. 44

HAIR TREATMENT DEVICES AND PACKAGING THEREFOR

INTRODUCTION

The present invention relates to hair treatment devices capable of effective and efficient use for parting hair to form strands or tresses and for spreading a hair treating liquid into successive tresses with excellent control. It also relates to packaging for hair treating materials used with the devices.

A hair treatment device according to the invention is used in connection with a handle, preferably in the form of a suitable container for a supply of liquid hair treating composition, such as a squeeze bottle, for the controlled application of such liquid to portions of the hair selected by a cosmetologist or other operator for treatment. Hair treating operations for which preferred devices of the invention are capable of supplying and applying the necessary liquid in a controlled manner include, among others: hair coloring, including permanent, semipermanent and temporary hair coloring; hair tinting; hair toning, hair bleaching and lightening; hair painting; hair shading; hair frosting; hair tipping; hair straightening; hair conditioning and reconditioning; hair waving, including permanent waving and setting; hair care and grooming; and the like. The devices are adapted for use by nonprofessionals as well as professionals in any and all of these operations and can be used with equal ease in hair treating operations by right-handed and left-handed operators. In preferred forms the devices have a one piece molded plastic body which is unaffected by any of the treating liquids to be used therewith and they are free of projections which would become entangled with and pull the hair during the treating operations.

The package comprises a multiple compartment container, e.g., an outer container and at least one inner container, or adjacent compartments, for holding reactive materials that must be kept separate until just prior to use and for best efficiency should be protected against exposure to the atmosphere between the time of mixing and application to the hair. The containers are made of thin material that can be manipulated to open the barrier between the compartments and mix the contents while the exposed wall of the container remains intact. The package has its greatest utility when one compartment contains a powder and another a liquid and in such a package it is the compartment containing the liquid that is opened so that its contents are emptied into the other one. The seal between adjacent compartments and the material of which an inner container is made provide a barrier between the contents of the respective containers until the barrier is broken in the manipulation to admix the materials.

BACKGROUND OF THE INVENTION

Hair treatment, including hair coloring, is an ancient art. The oldest available records show that women then, as now, were not satisfied with their natural hair coloring and used available materials in an attempt to obtain a hair color which they considered more desirable than nature had provided. Among other coloring materials that were used aciently are henna, a red vegetable dye; indigo; sage; and camomile. Dark haired women in the time of Rome's zenith, who admired the blonde hair of female slaves brought from northern Europe, used saffron, red arsenic, nut shells and plant ash to bleach their hair. Later it was found that if the hair was wet with soap and exposed to the sun it would lighten. Mixtures of alum, black sulfur and honey have also been used as lightening agents. In the latter part of the 19th century synthetic dyes, particularly paraphenylenediamine, were developed and offered for hair coloring, either alone or in admixture with metallic salts. Oxidizing agents, particularly hydrogen peroxide, came into rather widespread use as the bleaching agent to lighten hair.

Until relatively recent times little was known and understood about the structure of hair and the mechanics of hair coloring. Through microscopic study of the hair it has been determined that a typical hair shaft, the part of the hair outside the hair follicle where the hair is formed, comprises an outer sheath of scales called the cuticle, the main body of the hair called the cortex and a slender central filament called the medulla.

The scales of the cuticle are plate-like in shape and cover the cortex somewhat in the same general manner that shingles cover a roof where the root of the hair corresponds to the ridge and the end of the hair corresponds to the eaves. This arrangement of the scales permits the hair to be combed from the scalp outward without damage to the cuticle, just as water can flow down a roof that is well shingled without causing leakage, whereas brushing or combing the hair toward the scalp tends to damage the cuticle just as a stream of water directed upwardly on a roof could easily cause leakage by penetration between the shingles and, if the force of the upwardly directed stream is strong enough, the shingles could be lifted and even torn from the roof. Being transparent, and colorless, the scale cells of the cuticle are not altered in color by bleaching agents but they must be altered structurally so as to permit the coloring solutions to pass through the cuticle and penetrate the cortex and the cuticle may be subjected to damage if the treating liquids are improperly used.

The cortex is composed of elongated cells, rather typical of fibers, comprised of complex proteins among which all the pigments that give the hair its color are found. Pigments are of different colors, such as yellow, red, brown, black, etc., and in general a hair shaft will contain pigment cells of several different colors. Pigments of different colors are affected differently by bleach and lightening solutions. In general such solutions attack the darker colors first and it has been found useful to divide the bleaching or lightening process from black to very light hair in stages which are referred to as follows:

Stage 1—black
Stage 2—brown
Stage 3—red
Stage 4—red-gold
Stage 5—gold
Stage 6—yellow
Stage 7—pale yellow
Stage 8—white Bleaching and lightening liquids, however, affect not only the pigment cells but also other cells of the hair and some chemical bleachants under some conditions may have a variety of adverse effects on the structural part of the hair, e.g., seriously weaken or embrittle the hair so that it will break off in wet or dry condition; cause hair to lose its normal springiness or resilience when highly bleached (to Stage 7 or 8) so that in wet condition it feels like sponge or rubber, will stretch like a thin rubber filament if pulled, will break if stretched beyond the elastic limit, and in dry condition it is brittle and snaps off if bent; and reduce the ability of the hair to take up color in the normal manner. In many cases the scalp may also be deleteriously affected by contact for too long a period of time with the bleachants used on the hair.

The medulla is not always present and is of little importance in coloring and otherwise treating the hair.

Hair coloring of the permanent type as practiced today may be carried out (a) in two operations which are frequently referred to as (1) bleaching or prelightening and (2) tinting or coloring, or (b) in some cases, in a single operation which comprises bleaching or lightening the natural pigments and simultaneously depositing other pigments in the cortex of the hair.

The one step process was not introduced in the market place until about 1950 after which it became very popular but it has not completely displaced the two step process which is still necessary if a person desires to change the color of the hair through several stages of lightening.

Permanent hair coloring is somewhat of a misnomer because no known process of hair coloring is able to affect the natural color of new hair that grows out after a so-called permanent color is applied. The word "permanent" as used in this art means only that the color which is applied to the then existing shaft of the hair is not washed out with shampoo and water. The most popular way of obtaining permanent hair coloring is by the use of penetrating tints or dyes which deposite pigment in the cortex of the hair shaft. It is possible, however, to apply a coating tint on the cuticle layer but this produces an unnatural look that most persons consider far less satisfactory than the appearance obtained by the use of a penetrating tint.

Semipermanent hair coloring differs from the permanent type in that it will wash out but requires several shampooings before all the color is removed. It is used primarily either to color gray hair without changing the color of the remaining pigmented hair or to make gray hair a color that the person prefers to the natural gray. In general the coloring materials used to obtain semipermanent hair coloring are the penetrating type but they are gentler on the tissues and require no peroxide developer.

Temporary hair colorings differ from the permanent and semipermanent colorings in that they deposit color on the cuticle of the hair shaft, have no lasting effect on the hair color and are washed out by shampooing. In general temporary hair coloring materials are either rinses, highlighting shampoos or materials that can be applied to the hair in the form of powders, creams, or sprays.

Hair treating materials that are applied to the hair as a liquid may be any of these types:

(a) a single material which is normally liquid within the temperature range used for hair treating, (b) a solution of one or more materials in a liquid vehicle, including coloidal solutions, emulsions of one liquid in another, or (c) suspensions of a finely divided solid material in a carrier liquid.

These materials have various viscosities and flow rates that may vary with temperature.

There are two general ways in which liquids are applied to the hair to be treated. One may be called an all-over application process of which coloring shampoos and rinses are typical examples. This method has been used satisfactorily for certain types of hair treating materials which are relatively nonirritating to the scalp, nondamaging to the hair and which do not have critical time periods that must be observed in order to get satisfactory results. Many hair treating materials do not satisfy these criteria and are therefore applied in the other method which may be called a step-wise or progressive method, i.e., the treating liquid is applied successively or progressively to small sections of the hair until the entire operation of treating the entire head of hair therewith has been completed. The present invention is intended for use primarily in this other method, i.e., the progressive application of hair treating liquids. Various methods are already known for effecting this progressive application of a hair treating liquid to the hair. Beginning some four decades ago color was first applied with a swab. This was followed by the bowl and brush method in which the liquid to be applied was prepared in an open bowl and applied by means of a brush that was dipped into the liquid in the bowl and then moved to the section of the hair that was ready to receive the liquid where it was applied by brush strokes primarily in the direction from the scalp toward the ends of the hair. These methods were relatively slow and time consuming and with hair treating materials that were unstable in an open bowl it was necessary frequently to prepare fresh solution, e.g., even an experienced operator working at efficient speed had to mix fresh solutions two or more times in the treatment of a single head of hair while inexperienced operators working at less efficient speed had to mix fresh solutions more times. A major improvement in application of hair treating liquids to the hair came with the use of a squeeze bottle having an externally threaded cylindrical neck on which a sectioning and dispensing attachment or applicator is screwed. This attachment comprises a body having an internally threaded cylinder or collar to be screwed on the neck of a squeeze bottle projecting outwardly in one direction and an elongated projection extending outwardly in the opposite direction, e.g., a frustum of a cone or the like, having a tapered passageway for liquid passing completely through it. The hollow projection is referred to in the art variously, e.g., as a tip or knife. A bottle and attachment of this type is shown in Levie U.S. Pat. No. 2,794,440 for hair waving solutions. An operator is able to form successive sections of a customer's hair with such a device by holding the squeeze bottle as a handle and using the tip in the same way that a rattail comb is used, although Levie shows the use of a rattail comb anyway. Such a section of the hair, which may be about 1 to 3 or 4 inches wide and ordinarily not more than about ⅛ inch thick, is referred to variously in the art as a lock, strand or tress of hair. After the operator has formed such a strand of hair in this way, it is held taut by one hand while the other hand squeezes the bottle to force a thin stream of liquid through the tip onto the scalp along the near part line of the strand at the area to be treated. In carrying out a maintenance or touch-up treatment, for example, where the root area of the hair has grown out since the last hair treatment and now requires coloring to match the existing color of the remainder of the hair, the thin stream of liquid at the part line must next be spread evenly and uniformly on only the new growth, which is a difficult operation requiring great skill with known tools and techniques because if "overlapping" of treating liquid onto the previously colored hair occurs it may result in hair breakage in the overlap area, nonuniform coloring which may persist until the hair has fully grown out, and other disadvantages. The smooth tip of the applicator is worthless as a spreading device, or as a device to pick up excess dripping material near the hairline, so most operators effect the spreading and pick-up of the liquid squeezed out of the applicator with the thumb of the hand that holds the strand of hair being treated. This strand should be kept taut while the treating liquid is spread over the root area in order to control the extent of the spread to new growth only, but this is not possible when the thumb of the same hand is used to spread the liquid, particularly if the hair is more than a few inches long because the ends of the hair above the place where the fingers grip the strand must be kept out of the way of the spreading operation. This cannot be accomplished if the hair is grasped close enough to the root to spread liquid with the thumb of the same hand. The thumb spreading operation has many other difficulties and disadvantages.

One is that the thumb is a very poor, inaccurate and inadequate spreading instrument. The inaccuracy and inadequacy are particularly disadvantageous in treating hair having a so-called "gold-band" which frequently occurs on a head of dark hair that has to be prebleached before toning and which is resistant to coloring or toning so that on a touch-up the root area is not the same color as the remainder of the hair. On the next touch-up if bleach is applied to both the new hair and the gold band for the same length of time the hair shafts in the gold band area are damaged and may break. If a beautician tries to spread the prebleach liquid with her thumb only on the new area and then later to extend the liquid into the gold band area so as to bring the new hair and gold band to the same bleached condition with minimum damage it is almost impossible to do it accurately so current practice is to spread it as well as possible on the new hair and the gold band, despite the adverse results.

A second example of difficulties arising from the inaccuracy and inadequacy of the thumb as a spreading tool is in the treatment of the short hair line hairs which are too short to grasp with the fingers, or even to part. Proper treatment of those hairs requires a spreading motion from the scalp outwardly but most beauticians spread the liquids by a transverse or rotary mortion of the thumb that is damaging to the hair.

A third difficulty is that when the thumb of the hand that holds the tress is used to spread the liquid, which is the only one the beautician can use without setting the squeeze bottle down, the hair tress has to be relaxed instead of being held taut in order for the thumb to reach the root area to spread the liquid.

A fourth difficulty is in treating a virgin head of hair that requires prebleaching and toning. The shaft has to be bleached either twice or for a longer time than the root area, where body temperature speeds up the rate of bleaching. In applying the bleach initially the place to start should be an inch or so away from the scalp and then be spread out to the end of the hair. Where this spreading is done by the thumb against the strand that the fingers are holding, the tress relaxes and the bleach tends to seep down to the scalp. The seepage is encouraged by the wiggling or twirling of the hair due to working of the liquid into the tress by the fingers and thumb of the operator. Then when the root area is treated, the scalp gets a second exposure to the bleach liquid while still tender from the first contact by seepage and may become so tender that it is abraded in the toning operation.

A fifth difficulty is that the operator has to wear a rubber glove at least on the hand that spreads the liquid or subject it to serious attack by prolonged exposure day after day to the relatively harsh chemicals that are used in the hair treating operations. An operator is not only subject to surface attack on the skin from the chemicals as such but also frequently the operator becomes sensitized to ingredients in the treating liquids with a resultant allergic reaction to them.

Many proposals have been made for various forms of applicators intended to overcome one or more of the disadvantages and problems mentioned above. For example, fountain brushes and other types of applicators are disclosed in prior patents, such as Holden U.S. Pat. No. 1,172,889 which has no parting tip, Battle U.S. Pat. No. 2,299,296 which has a solid tip but requires a special and expensive bottle, Gaspari U.S. Pat. No. 2,617,431 which has a comb and fountain brush on opposite sides of an applicator head but no tip and Pearson U.S. Pat. No. 2,618,275 which shows a round brush axially aligned with the bottle that makes accurate controlled application of liquids to the root area of hair from a straight part line difficult if not impossible. Pearson also suggests using a curved comb either adjacent to the base of the brush with the aligned tines arranged transversely with respect to the axis of the brush and bottle or at the opposite end of the bottle, but these cannot function as a parting and dispensing tip. Still other proposals include Meyer U.S. Pat. No. 2,819,723 which suggests using a solid tip at the end of a device including a fountain brush and fountain comb from which a mixture of latent dye and activator from separate containers can be dispensed selectively, Stanford U.S. Pat. No. 2,956,570, which is somewhat similar to Meyer except it suggests only a single container and a fountain comb, and Di Vito, which is similar to Stanford except that it suggests that the tip may be hollow to serve also as an applicator but discloses no means to control flow selectively to tip or comb. A further suggestion is made in McDougall-Kaley U.S. Pat. No. 3,204,644 of providing a solid tip extending laterally from the axis of a bulbous reservoir and a fountain roller at the top to apply liquid across the root area of a strand of hair adjacent to the scalp. Such a roller cannot be used satisfactorily to treat hair in which the length of new growth is less than the axial length of the roller and it is not suitable for applying liquid to the shaft of strands of hair from the root area at the scalp out to the ends which is necessary with virgin heads of hair, with heads of hair that are to be colored to a new shade or tint, and with heads of treated hair for which maintenance has been delayed too long. With the exception of the squeeze bottle and simple hollow tip applicator of the type illustrated in the Levie patent in which the tip is aligned with the axis of the bottle or displaced therefrom by an acute angle of up to at most about 30°, none of these devices within applicant's almost two decades of experience in commercial beauty salons has ever come to her attention except as a result of searches made in connection with her present invention. They clearly demonstrate, however, the wide spread but unfulfilled need in the art for a hair treatment device that overcomes the disadvantages and problems mentioned above and which provides an efficient, convenient, attractive, and relatively inexpensive hair treating device for conventional squeeze bottles containing hair treating liquids.

As described above, the use of a squeeze bottle and tip applicator improved the application of liquids to the hair but difficulties with mixing some materials that have to be kept apart until just before application persist. For example, bleach liquids frequently are mixtures of a liquid with finely divided powder that is injurious to eyes and detrimental if inhaled. A very recently introduced package for these materials comprises a can of the powder, a bottle of the liquid, two packages of powdered protinator, and a plastic stirrer in a mixing bowl. The can contains a warning to open it pointed away from the eyes and not to inhale the inevitable dust as it is emptied into the bowl for mixing with the liquid (and optionally also with protinator). The mixture then has to be applied with the stirrer, or put into a squeeze bottle for application. No better way has been known or used in the hair treating field.

DESCRIPTION OF THE INVENTION

The present invention will now be described in conjunction with the drawings illustrating a number of specific embodiments thereof in which:

FIG. 1 is a perspective view of a preferred embodiment of the hair treatment device of the invention secured to a conventional squeeze bottle held by a human hand in position for making a parting;

FIG. 2 is a longitudinal sectional view through another embodiment of the invention secured to a conventional squeeze bottle;

Figure 18:
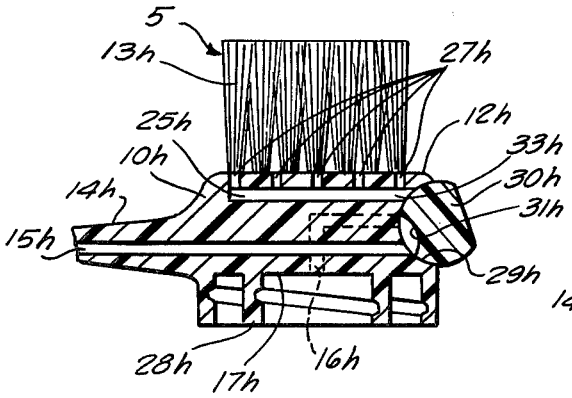
Figure 19:
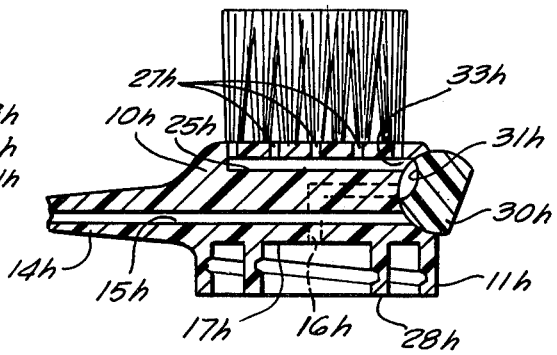
Figure 20:
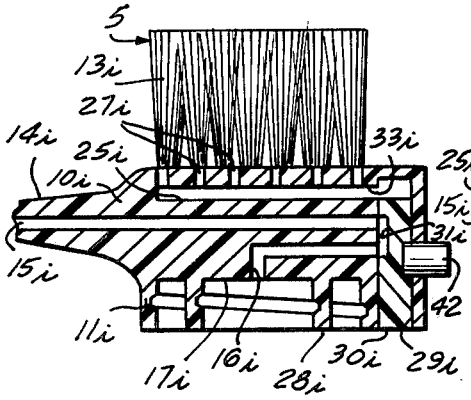
Figure 21:
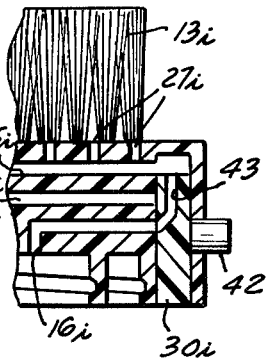
Figure 22:
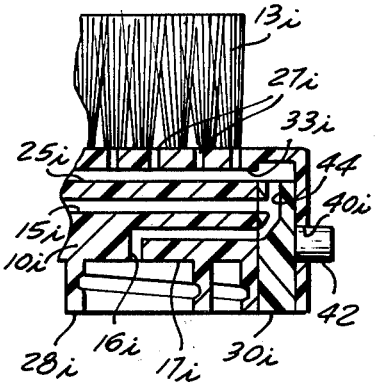
Figure 22A:
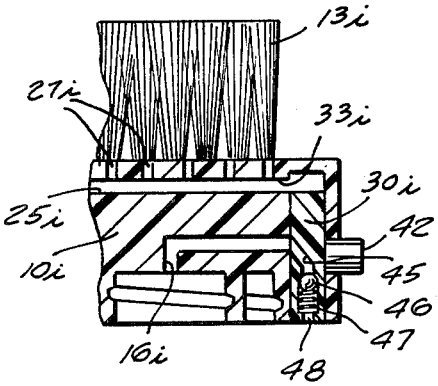

FIG. 2*a* is a longitudinal sectional view of a further embodiment of a hair treatment device of the same general shape as the one illustrated in FIG. 2 but of different construction;

FIG. 3 is a perspective view of a preferred embodiment of hair treatment device viewed from a level somewhat above it;

FIG. 4 is a vertical sectional view of a hair treatment device having a hollow tip for liquid application similar to that shown in FIG. 3 together with an adapter that enables a conventional 5 oz. squeeze bottle to be secured to such a device which has a threaded collar size to fit a conventional 8 oz. squeeze bottle;

FIG. 4*a* is a fragmentary longitudinal section through a hollow tip for a hair treatment device which has a removable end piece for varying the orifice size of the outlet to adapt the device for use with hair treating liquids of varying viscosities;

FIG. 5 is a vertical sectional view of a hair treatment device similar to that shown in FIG. 4 in which liquid feed is to the brush rather than the tip and threaded collars for both bottle sizes are molded with the body as integral parts of the device;

FIG. 6 is a vertical sectional view of a hair treatment device similar to FIG. 4 except that the body is modified to hold the tip at a different angle to the axis of the threaded collar, which is also the axis of a squeeze bottle secured to the collar, from the right angle shown in FIG. 4;

FIG. 7 is a vertical sectional view of a hair treatment device similar to the embodiment illustrated in FIG. 4 in which the tip is a separate molded piece pivoted to the molded body for universal movement, e.g., to any degree of angular adjustment (a) in a vertical plane with respect to the axis of the collar, between an obtuse to an acute angle, or (b) in a horizontal plane with respect to the direction of the long dimension of the spreading means, between a right angle at the back to a right angle at the front, and combinations thereof;

FIG. 7*a* is a fragmentary cross-sectional view through the axis of a tip and body showing a different joint that permits movement of the tip through about 180° without interrupting the passageway from the tip through the body and with detent means to hold the tip removably in any one of a plurality of selected angular positions;

FIG. 8 is a vertical sectional view of a hair treatment device combining the features of devices illustrated in FIGS. 4 and 5 having a valve rotatable around a horizontal axis for selectively directing liquid from a squeeze bottle either through the tip or to the brush;

FIG. 8*a* is a fragmentary sectional view along the line 8*a*—8*a* of FIG. 8;

FIG. 9 is a view of the device illustrated in FIG. 8 in elevation as viewed from the right in the direction of the arrows at the ends of line 9—9;

FIGS. 10 and 11 are vertical sectional views of a hair treatment device similar to FIG. 8 having a valve rotatable about a vertical axis for the same purpose shown in position to direct liquid through the tip in FIG. 10 and to the brush in FIG. 11;

FIG. 12 is a vertical sectional view of a hair treatment device similar to FIG. 8 having a valve slidable along a transverse axis for the same purpose with the valve positioned to direct liquid through the spout;

FIG. 13 is a vertical sectional view of the hair treatment device of FIG. 12 on a plane at right angles to the plane of FIG. 12 and on the line 13—13 thereof;

FIG. 14 is a vertical sectional view of the device of FIG. 13 with the valve slide moved in the direction of the arrow far enough to direct liquid to the brush instead of through the tip;

FIGS. 15, 16 and 17 are fragmentary vertical sectional views of a hair treatment device similar to FIG. 12 having a slide valve movable on a vertical axis to positions to direct liquid (a) through the tip as shown in FIG. 15, (b) to the brush (brush fibers omitted for simplicity) as shown in FIG. 16, and (c) to both as shown in FIG. 17 which is a useful position for rinsing the device after use;

FIGS. 18 and 19 are vertical sectional views of a hair treatment device similar to FIG. 8 in which an oscillating valve pivoted on a transverse axis is provided which can readily be moved by a thumb to direct liquid through the tip as shown in FIG. 18 or to the brush as shown in FIG. 19;

FIGS. 20, 21, 22 and 22*a* are fragmentary vertical sectional views of a hair treatment device similar to FIG. 15 having the valve movable around a vertical axis to a selected position (a) which directs liquid through the tip in FIG. 20, (b) which directs liquid to the brush in FIG. 21, (c) which directs liquid to both in FIG. 22, and (d) which closes the device against discharge unless the pressure generated is high enough to open a pressure relief valve in FIG. 22*a;*

Figure 22B:
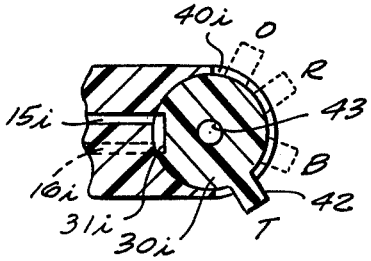
Figure 30:
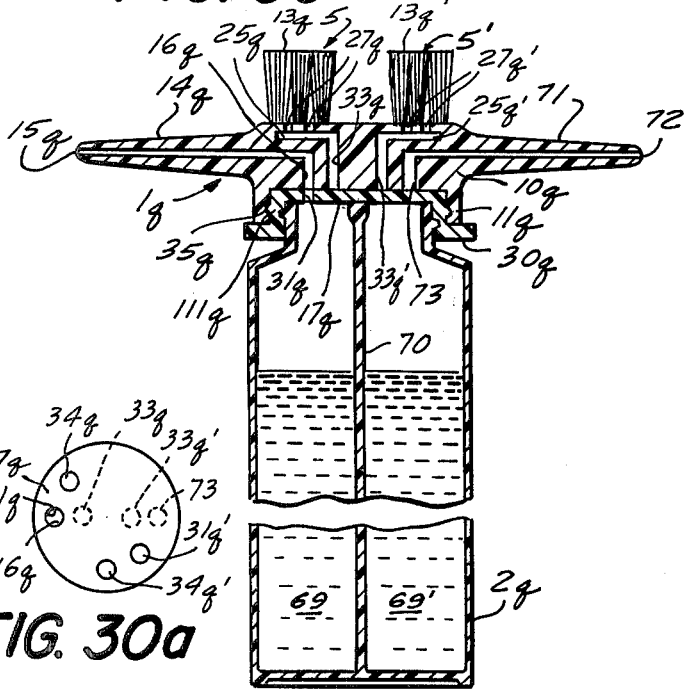
Figure 30A:
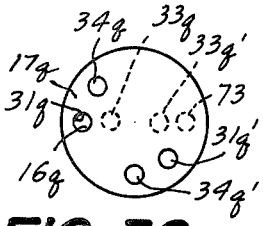
Figure 31:
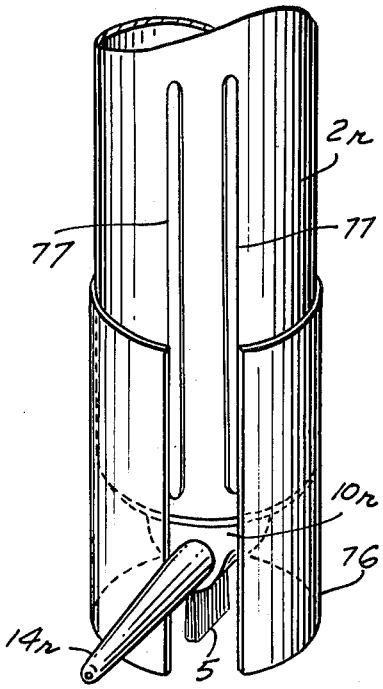
Figure 32:
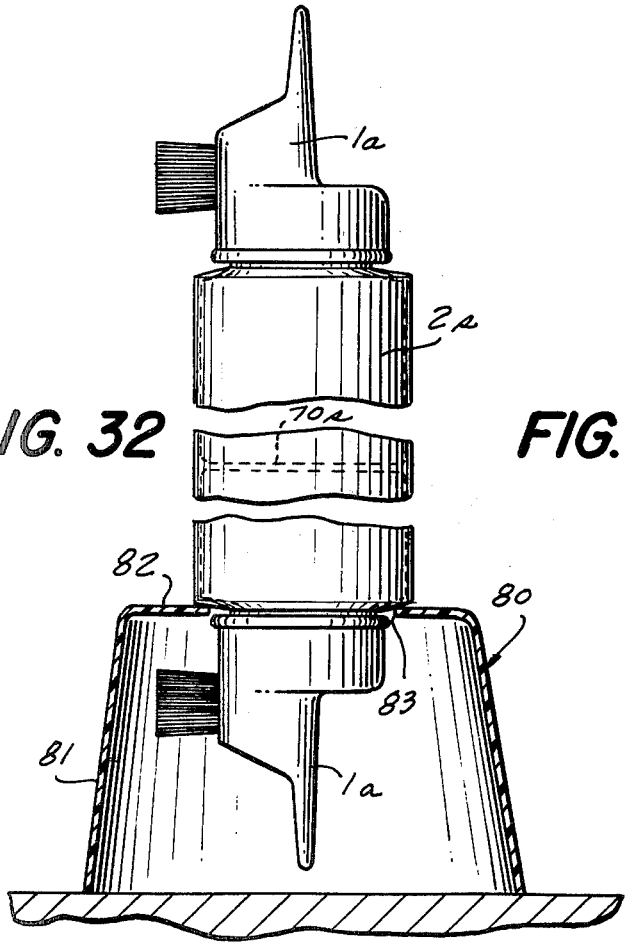
Figure 33:
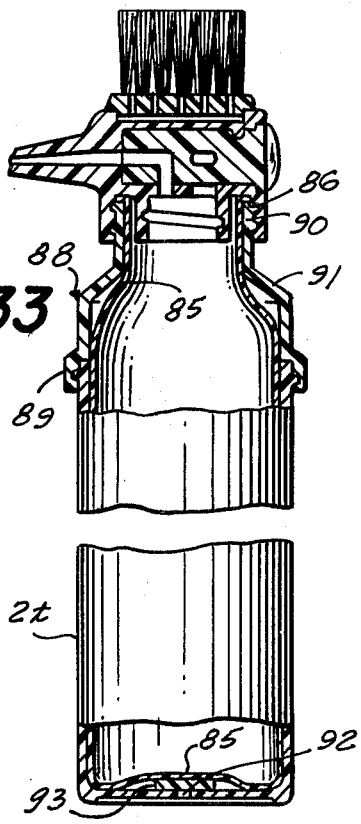
Figure 45:
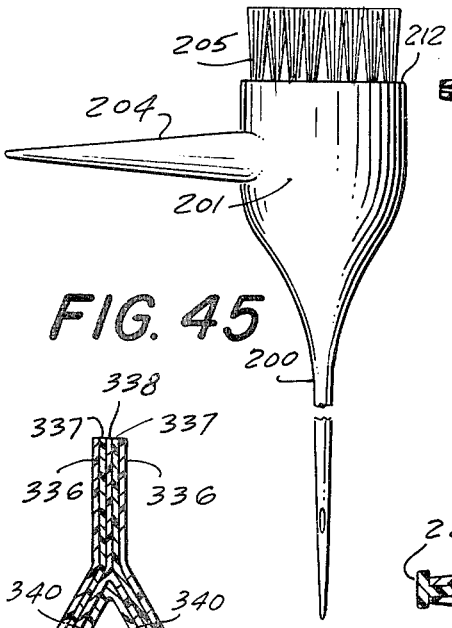
Figure 51:
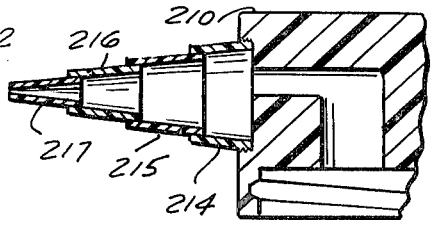
Figure 47:
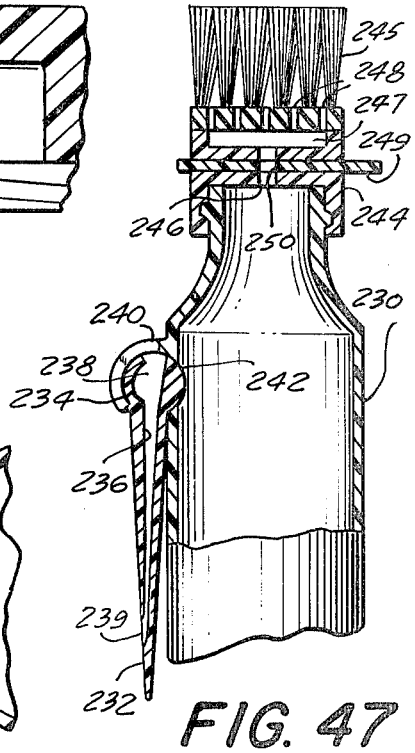
Figure 54:
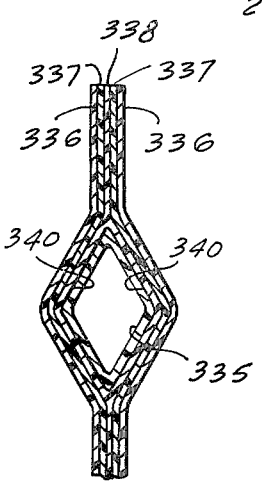
Figure 46:
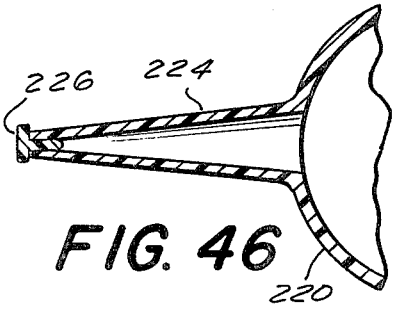
Figure 49:
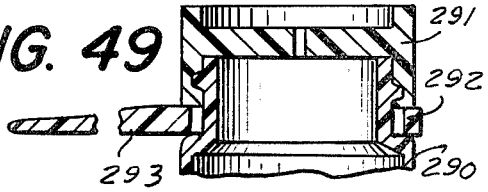
Figure 48:
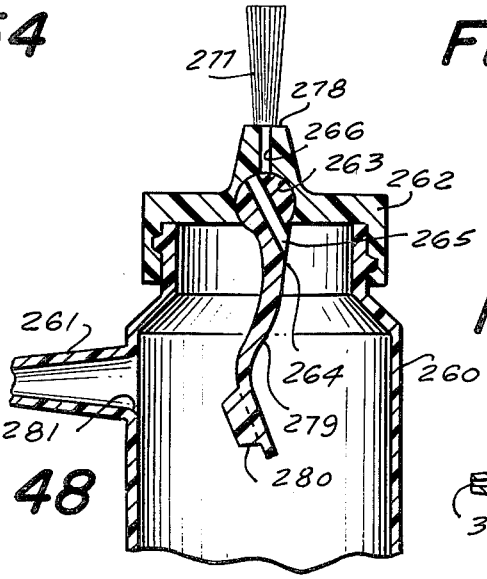
Figure 50:
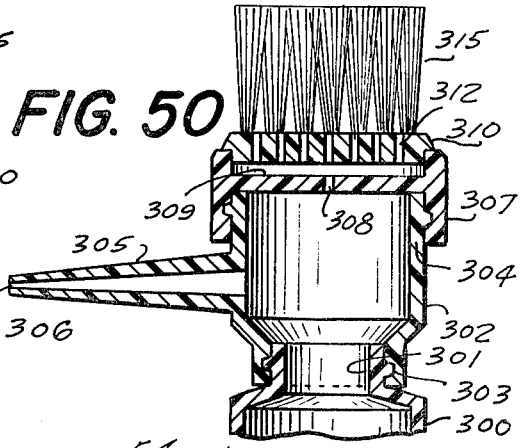
Figure 52:
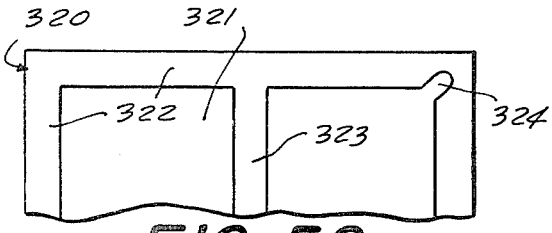
Figure 53:
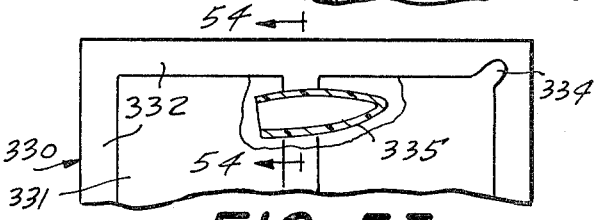

FIG. 22*b* is a fragmentary cross-sectional view through the valve showing the four respective positions of the valve that can be selected for delivery through the tip (T), to the brush (B), to both for rinse (R) or to neither for off (O);

FIG. 23 is an exploded perspective view of a hair treatment device similar to the embodiment illustrated in FIG. 8 in which the brush fibers are mounted in a base that is removable by lifting it vertically from a recess in the body of the device and a flow control plate is provided for said recess below the brush base;

FIG. 24 is an exploded perspective view of a hair treatment device similar to the embodiment illustrated in FIG. 8 in which the brush fibers are mounted in a base having a dovetail projection slidable into and out of a complementarily shaped recess in the body of the device on an axis parallel to the axis of the tip;

FIG. 25 is an elevational view of a hair treatment device similar to the embodiment illustrated in FIG. 9 in which the bristles and base of the brush are arranged at an angle to the dovetail projection and the valve has an operating handle adapting the flow control means for operation by a thumb;

FIG. 26 is a fragmentary front elevational view of a hair treatment device and attached squeeze bottle in working position showing a dispensing tip on an axis substantially at a right angle to the axis of the squeeze bottle and attaching collar;

FIG. 27 is a fragmentary front elevational view similar to FIG. 26 with a dispensing tip having an end projection to form a cradle for a strand of hair;

FIG. 28 is a fragmentary front elevational view similar to FIG. 27 except that the axis of the tip forms an acute angle with the axis of the squeeze bottle and the threaded collar;

FIG. 29 is a fragmentary front elevational view, with some parts in section, of an embodiment somewhat similar to FIG. 28 except that the axis of the tip is substantially at a right angle to the axis of the threaded collar, as in FIG. 27, and the acute angular relation of the axis of the tip to the axis of the squeeze bottle, as in FIG. 28, is achieved by an adapter;

FIG. 30 is a vertical sectional view through a hair treatment device having two tips at opposite sides of the body and two spaced elongated spreading means, each aligned with an adjacent tip, the body being secured in liquid tight relation to a two-compartment squeeze bottle and having valve means to select the compartment and tip or spreading means for discharge of liquid;

FIG. 30*a* is a bottom view of the inner surface of the valve of FIG. 30 showing the locations of the passageways through it in relation to the passageways in the body leading to the respective tips and spreaders;

FIG. 31 is a fragmentary perspective view of a squeeze bottle and hair treatment device similar to the embodiment illustrated in FIG. 1 with a split sleeve stand slidable axially of the bottle to and from the operative stand position illustrated;

FIG. 32 is a fragmentary elevational view of a squeeze bottle having two compartments in tandem and two threaded necks with a hair treating device of the general type illustrated in FIG. 2 secured to each, and a stand (in vertical section) adapted to hold the assemblage in upright position;

FIG. 33 is a vertical elevational view, partly in section, of a two part squeeze bottle having a thin plastic liquid container assembled therein and held in liquid tight relation thereto by a hair treatment device for direct dispensing from such container;

FIG. 34 is a vertical elevational view of the thin plastic liquid container with a second thin plastic container within it for a second material to be mixed with the material in the first container just before using the mixture;

FIGS. 35, 36 and 37 are front elevational views of bristles and tines of various relative lengths mounted in bases for use in hair treatment devices of the type illustrated in FIG. 23;

FIG. 38 is a front elevational view of a comb mounted in a base for use in similar hair treatment devices;

FIGS. 39 to 43 are fragmentary views of bases for brushes having different embodiments of liquid passageways;

FIG. 44 is a fragmentary vertical sectional view of a hair treatment device having a grooved fountain roller mounted on a shaft parallel to the axis of the hollow tip and a valve for selectively directing liquid to the tip or roller;

FIG. 45 is an elevation of the simplest embodiment of a hair treating device of the invention in which the handle serves only for grasping the device in the hand;

FIG. 46 is a fragmentary cross-sectional view of a squeeze bottle usable in a different embodiment of the invention having the tip formed integral therewith;

FIG. 47 is a fragmentary vertical sectional view of another embodiment of the invention having a squeeze bottle similar to that illustrated in FIG. 46 in which the tip is secured to the squeeze bottle adjacent to the neck by a movable joint that permits the tip to move through an angle of about 180° and a spreader cap is secured in liquid tight relation to the neck. The passageway through the tip is closed in the down position and the passageway to the spreader may be opened and closed by a valve slide;

FIG. 48 is a fragmentary vertical sectional view of an embodiment similar to that illustrated in FIG. 46 in which a spreader cap has a rotary valve to open and close the passageway to the mounting area and a tip closure valve movable therewith to close the passageway to the tip when the passageway to the mounting area is open and vice versa;

FIG. 49 is a fragmentary vertical sectional view of a different embodiment of the invention showing the neck end of a squeeze bottle having a removable tip-bearing collar secured thereon by a dispensing and spreading cap;

FIG. 50 is a similar fragmentary vertical sectional view of a still different embodiment of the invention in which the tip-bearing collar is secured to the neck in such a way as to permit liquid to be discharged from the tip;

FIG. 51 is a fragmentary vertical sectional view through a collapsible tip;

FIG. 52 is a fragmentary plan view of an embodiment of a package for two hair treating materials;

FIG. 53 is a fragmentary plan view of another embodiment of a similar package; and FIG. 54 is a fragmentary vertical sectional view of the package of FIG. 53 along line 54—54.

The invention has many facets as the brief descriptions of the figures of the drawings show.

On facet of the invention relates, in simplest form, to a hair treatment device having a handle suitable for grasping in a hand of the user, a tip or knife for parting the hair extending outwardly adjacent to one end of and at a substantial angle, preferably about a right angle, to the long axis of the handle, and an elongated spreading means at that end of the handle with the long dimension of the spreading means, looking down on that end, in the same general direction as the tip. This arrangement permits an operator to part a strand or tress of hair with the tip and to spread hair treating liquid into and along the tress by moving the spreading means outwardly, i.e., in a direction from the root to the free end, transversely to the axis of the tip. With this arrangement of the parts the operations of parting to form tresses and of applying liquid thereto are rapid and efficient requiring no change of position of the device in the operator's hand. The handle may be an integral part of the device, as shown in FIG. 45, but advantageously it is a removable part, as shown in FIGS. 1, 3–30, 33, 44 and 46–50, which preferably is in the form of a squeeze bottle and the device in this preferred form is provided with a liquid passageway to conduct liquid from the squeeze bottle to the tress so that it may be spread along and into it by the spreading means, as illustrated in FIGS. 4, 5, 6, 7, 29, 46, 49 and 50. A still further advantage is achieved by providing means to dispense liquid from the squeeze bottle handle through a discharge orifice in the tip and through a discharge orifice near the spreading means with means for selectively dispensing liquid through one discharge orifice or the other, as illustrated in FIGS. 1, 8–28, 30, 44, 47 and 48 for devices having the tip at a substantial angle to the axis of the handle, and in FIGS. 2, 2*a* and 32 for devices having the tip extending outwardly in substantially the same direction as the axis of the handle. Indicia, both visual and tactile, are optionally provided to apprise the operator what discharge orifice is operable. Since liquids of different viscosities are used in hair treating, the invention contemplates and provides means for varying the effective diameter of the discharge passageways to correlate with viscosity, as shown in FIGS. 4, 4*a*, 7 and 23.

A preferred elongated spreading means contemplated by the invention has means to penetrate between the hairs in a tress as the device is moved in a direction transverse to the axis of the tip, and may be in the form of a brush, as shown in FIGS. 1–33 and 45–50, a grooved roller as shown in FIG. 44, tines as shown in FIG. 38 or both tines and bristles as shown in FIGS. 35–37.

The device is preferably made adaptable for use with squeeze bottles of different neck sizes by providing adapters as shown in FIGS. 4 and 29 or multiple attaching flanges as shown in FIGS. 5, 8 and 10–22.

In the preferred embodiment of the device having two discharge orifices and means to discharge liquid selectively from one or the other of them the invention contemplates providing means to supply cleaning liquid simultaneously to both discharge orifices as shown in FIGS. 15–22*b* and 47.

Another facet of the invention relates, in simplest form, to means for mixing two materials, usually a powder and a liquid that are required for a hair treating operation but which must be packaged separately, mixed just prior to use, and applied in such a way as to preclude substantially prolonged exposure to the atmosphere before application to the hair.

One way of mixing a powder and a liquid is to pour the powder from its shipping container into a squeeze bottle, add the liquid thereto and shake vigorously. In order not to spill the contents from the bottle during such shaking a device may be placed on the neck of the squeeze bottle that has an "off" position on the valve, e.g., as shown in FIG. 22*a*, and for the purpose of preventing excessive development of pressure in the closed system when the reaction has a gaseous by-product a pressure relief valve is contemplated, also as shown in FIG. 22*a*.

A preferred way of mixing two materials is to provide the powder in a manipulatable shipping container in order to avoid the necessity of any transfer from shipping to mixing container, e.g., a thin walled plastic container, add the liquid to the powder and manipulate the container to mix them thoroughly. Advantageously the liquid is provided in a separate container adjacent to or within the other manipulatable container which has these essential features:

(a) it provides a barrier for premature transfer of the liquid in it into the powder so that the completed package has good shelf life; and (b) it is rupturable by manipulation so as to discharge its contents into the other container for mixing with its contents.

This same packaging structure may be used as well when the material in the outer container is a liquid. FIGS. 34 and 52–54 illustrate embodiments of such packaging structure. The outer or mixing container may be provided with a discharge outlet in the form of an annulus to fit against the end of the neck of a squeeze bottle as shown in FIG. 33, in which case the inner container should be secured to the lower part of the outer container so as not to block the passageway in the device before the mixed contents are fully dispensed but the mixed contents can be flowed into a squeeze bottle for dispensing readily and without the difficulties and dangers of powder transfer.

Many other facets of the invention are contemplated and provided for optional and advantageous use where desired. They are described in the detailed description which now follows in connection with the embodiments of the invention illustrated in the various figures of the drawings but in many cases the structure of a particular facet which is illustrated in connection with one embodiment of hair treating device may be incorporated also in other embodiments of hair treating devices within the scope of the claims including those illustrated in other figures of the drawings.

Referring now first to FIG. 1, a hair treatment device referred to generally by reference number 1 is secured in liquid tight relation to a squeeze bottle designated generally by reference number 2 to form a combination that may be held in the hand 3 of a cosmetologist or other operator (not shown) in what will be called, for convenience of description, the upside-down or working position for sectioning and parting the hair of a customer for treatment and supplying one or more treating liquids to and spreading them on sectioned strands or tresses. In this combination the squeeze bottle 2 serves as a handle for manipulating the device 1 and as a pump for forcing liquid from the container 2 through the device 1 onto the hair in a controlled manner as hereinafter described. The means generally designated by reference numeral 4 for sectioning the hair is a single elongated projection or tip somewhat in the shape of the tip on a rattail comb that is used for the same purpose. In the embodiment of the invention illustrated in FIG. 1 the axis of the squeeze bottle 2, i.e., a line passing through the center of the bottom and the center of the neck, is approximately at a right angle to the axis of the tip, i.e., a line passing through the center of the tip from its free end to its attached end. The means 5 for spreading a liquid on the strands or tresses of sectioned hair is characterized by being elongated in the direction of the axis of the tip. The long dimension of the means 5 should be and preferably is several times, usually about 3 to 10 times, the length of the short dimension, as will be seen in the various views of different embodiments of the invention described in detail hereinafter. The long dimension of the spreading means is desirable for rapid spreading by movement in a direction transverse to its long dimension. The short dimension is necessary for accuracy. Thus, the relation of long to short dimension of the spreading means is very important, particularly in maintenance of hair, to achieve fast, accurate and controlled spreading of a treating liquid only on new hair. The spreading means 5 is further characterized by the ability to penetrate between the hairs in the strand or tress to obtain more uniform application of the liquid to all the hairs in a strand or tress as the means travels in a spreading motion in a direction from the root outwardly toward the free ends of the hairs so as not to injure the cuticle. Various embodiments of spreading means 5 described in detail hereinafter illustrate but do not limit the specific spreading means contemplated by the present invention. The means for supplying liquid for spreading may include a passageway adapted to communicate with the space in a squeeze bottle and with the exterior of the device through some means that places it where the spreading should begin. Such liquid supplying means may include the tip 4 and the spreading means 5, as more particularly explained hereinafter.

FIG. 2 illustrates a hair treatment device that has many features in common with the embodiment of the invention illustrated in FIG. 1, including a hair treatment device 1*a*, a squeeze bottle 2*a*, sectioning means 4*a* in the form of an elongated tip and spreading means 5*a*. In the embodiment of the invention illustrated in FIG. 2, the axis of the squeeze bottle 2*a* is approximately aligned with or parallel to the axis of the tip 4*a* whereas they are approximately at a right angle to each other in the embodiment illustrated in FIG. 1. Otherwise the above description of the parts of FIG. 1 applies also the the comparable parts of FIG. 2. In particular it should be noted that spreading means 5*a* is elongated in the direction of the axis of the tip 4*a*. Moreover, the relation of the tip 4*a* to the spreading means 5*a* is clearly seen to be the same in the device illustrated in FIG. 2 as is the relation of the tip 4 to the spreading means 5 in the device illustrated in FIG. 1. The difference between the embodiments illustrated in FIGS. 1 and 2 lies in the connection of the device to the squeeze bottle and this affects the way an operator grasps the squeeze bottle when the combination is used to treat the hair of a customer's head. In general applicant prefers the embodiment illustrated in FIG. 1 because it is not necessary to rotate the squeeze bottle in the hand when using it, which most operators do when using devices of the type shown in FIG. 2, and most of the description of the invention will relate to the embodiments in which the axis of the squeeze bottle bears a substantially right angular relation to the axis of the tip.

Referring now to FIG. 3 of the drawings, the hair treatment device is shown in what is referred to herein for convenience as the upright position and most of the description of this and other embodiments of the invention of this general configuration will relate to the arrangement of parts in this position in which they are also illustrated in the drawings. The device of this embodiment comprises a molded plastic body 10 having a flat, circular lower surface from the periphery of which means for removably securing it to a handle extends downwardly in the form of a cylindrical flange or collar 11 that terminates in a plane perpendicular to its axis. Any suitable type of connection between the body 10 and a handle may be used, such as a slidable snap joint, a bayonnet connection, a threaded connection and the like. On the upper surface of the body 10 opposite the collar 11 is a mounting area 12 for the spreading means 5 which in this embodiment comprises a plurality of upwardly extending elongated members capable of penetrating between hairs of a tautly held strand which, as illustrated, may be a brush 13. The mounting area 12 is relatively long in one direction, e.g., it has about the same length as the outside diameter of the collar 11. It is transverse to the axis of collar 11 and at a substantial angle with respect to it, in this embodiment approximately a right angle. The body 10 between the edges of the mounting area and the periphery of the lower surface is sloped or coved out, as seen in FIG. 3, so as to minimize the volume of plastic required to mold it and to provide clearance for use of the brush to spread liquid accurately and easily. In order not to bump the device against the head and interfere with the tilting of the device to see under it during a spreading stroke, the body of the device between the edge of the mounting area and the collar should not extend beyond a plane passing through the edge of the mounting area and lying tangent to the upper edge of the collar, and for economy the body in this region may be below this plane, as shown.

In the embodiment of FIG. 3 the mounting area 12 is substantially parallel to the lower surface 17 of the body, and to the collar terminating plane but other relationships are useful as will be described hereinafter.

The length and width of the mounting area 12 are somewhat greater than the length and width of the brush 13 at the base thereof where the bristles are secured to the body 10. As described above, the length of the spreading means 5, i.e., from the tuft of bristles at one side to the tuft of bristles at the other side, is several times as long as the width, and the mounting area corresponds generally to the ratios given above for the spreading means, i.e., some 3 to 10 times as long as wide.

The tip 4 in FIG. 3 is somewhat in the shape of a frustum of a cone 14. It is secured to the body 10 adjacent to one end of the elongated mounting area 12 and it extends outwardly on an axis substantially parallel to the long dimension of the mounting area. The axis is in a plane that passes through the midline of the long dimension of the mounting area and through a diameter of the collar. The brush 13 is symmetrical about this plane and the bristles extend upwardly in and adjacent to it. The axis of the tip is also perpendicular to the axis of the collar which is the same as the axis of a squeeze bottle secured to the body by means of the collar.

The device 1 as thus described is the simplest embodiment of the invention for use with a removable handle, such as a squeeze bottle, and when attached to a handle, which may have any suitable elongated shape that may be grasped in an operator's hand, e.g., somewhat like the squeeze bottle shown in FIG. 1, it enables an operator to part the hair with the tip 14 to form a strand of hair and then to spread with excellent control a hair treating liquid, that may be delivered to the hair in any suitable way as suggested hereinafter, along the strand to any desired extent by moving the brush 13 from a starting line outwardly to a stopping line or to the end of the strand. The control is possible because the shape of the elongated spreading means 5 and the contour of the body 10 permit clear vision of the portion of the strand with which the spreading means is to be placed in contact at the beginning and from which it is to be withdrawn from contact at the end of a spreading stroke. At the beginning of a spreading stroke the operator can tilt the device away so as to be able to see under it in order to lay the ends of the bristles against the starting line, e.g., at the root of the strand or about an inch away, as the case may be, to start to spread the liquid on and into the strand right at or a desired distance away from the scalp. Then the device can be tilted toward the operator far enough to be able to move it outwardly in the spreading motion to a stopping line, e.g., the outer end of the new growth area which can be seen at the sides of the brush where the spreading stroke must end in a touch-up operation in order to avoid damage and other disadvantages mentioned above that result from contact of treating liquids with previously treated hair. There is no part of the device that interfers with such movement around an axis approximately at and through the ends of the bristles of the brush 13.

In this embodiment of the hair treatment device it is not essential to include means for delivering hair treating liquid to the part of the strand of hair being treated. Instead of self-contained means to deliver such a liquid, it could be supplied, for example, from a squeeze bottle having a tip like that shown in FIG. 3 of the Levie U.S. Pat. No. 2,794,440 or the brush 13 could be dipped in a bowl of treating liquid in the manner formerly used with a simple brush. The device of FIG. 3 is much improved, however, if it is provided with means for delivering a liquid from a squeeze bottle serving as the handle through the body to one or more discharge orifices at the exterior of the device, as illustrated in the several embodiments disclosed herein.

Referring now to FIG. 4 the collar 11 is provided with means to secure the device in liquid tight relation to the neck of a squeeze bottle, e.g., an internal thread to conform to the external thread on the neck of a bottle of hair treating liquid. Hair treating liquids are currently marketed in such bottles. Tip 14 is provided with a liquid passageway 15 of gradually increasing diameter extending from the free end of the tip to the end attached to the body 10. This provides an operator with means to control the diameter of the discharge orifice at the outlet end of passageway 15 by snipping off the free end of the tip until the orifice has the right size to dispense a liquid having the particular viscosity of the liquid it is desired to dispense from the squeeze bottle under application of controlled pressure of the hand upon the flexible wall of the bottle. At the inner end passageway 15 communicates with a passageway 16 in the body 10 that opens through the lower surface at a position 17 which in use is exposed to the liquid in a bottle attached to the device.

Instead of making the passageway 15 with a gradually increasing diameter inwardly from the free end as shown in FIG. 4, which presents some problems in molding, the expedient illustrated in FIG. 4*a* may be resorted to provide means to vary the effective diameter of the passageways to the discharge orifice and to correlate it with the viscosity of the liquid to be discharged through it. Referring to FIG. 4*a*, the tip 14*a* is provided with a large enough passageway 15*a* of uniform diameter from its free end to the communication with the passage 16 (not shown in FIG. 4*a*) to discharge readily the most viscous liquid to be dispensed. A plurality of separate end pieces 18 may be provided, each having a passageway 19 therethrough which is specifically correlated with the viscosity of a particular liquid, and the selected one may be secured in any suitable way to the free end of tip 14*a* by a joint 20. The proper correlation of orifice sizes with the viscosities of all the liquids to be dispensed is thus achieved by providing a plurality of such end pieces molded with passageways 19 of various diameters, each correlated with the viscosity of a different liquid to be dispensed. Each such end piece may bear an insignia designating the liquid or the viscosity thereof which it is best adapted to discharge in a hair treating operation.

It will be noted in FIG. 4*a* that passageway 19 does not vent to the atmosphere from the very end of the tip, as does passageway 15 in FIG. 4, but instead is curved so as to give the stream of liquid discharged therefrom a component of motion at an angle to the axis of the tip. This has some advantage in use of the device for discharging liquid from the tip. Thus the operator using the device would part the customer's hair and form a thin tress or strand using the tip while the device is held in the right hand in the position shown in FIG. 1. With the hair of the strand or tress thus formed firmly held in the left hand the operator then draws the tip along the near part line from left to right while applying pressure to the squeeze bottle to force a stream of liquid out of the tip. With the tip 14 which vents through a straight passageway 15 as shown in FIG. 4, the liquid is given a purely axial direction which does not favor the flow of the liquid either way of the part whereas with a tip 14*a* having the passageway 15*a* curved as disclosed in FIG. 4*a*, the stream of liquid can be given a component of motion toward the strand or tress which the operator is holding in the left hand and into the hair of which the liquid is to be spread. The length of the end piece 18 relative to the overall length of the tip is not critical and may vary from a small fraction up to the full length of the tip in which case a plurality of tips having passageways of different diameters is provided instead of a plurality of end pieces. An example of a device in which the entire tip is molded as a separate piece is shown in FIG. 7 which will be described more fully hereinafter.

The particular form of the joint 20 for securing the end piece 18 to the tip 14*a* is not a part of the invention and any suitable joint which will not permit the end piece 18 to be forced off the tip 14*a* when the liquid is discharged through passageways 15*a* and 19 will be satisfactory. Among suitable joints are screw joints, bayonnet joints, slip joints, and the like.

It is present commercial practice to package hair treating liquids in 8 oz and 5 oz squeeze bottles with externally threaded necks but the diameter of the neck of an 8 oz. bottle is larger than the diameter of the neck of a 5 oz. bottle. It is desirable that the hair treatment device be adapted for use with both sizes of bottles. FIG. 4 discloses one expedient for accomplishing this result in the form of an adapter 21 which comprises an externally threaded collar 22 which corresponds to the neck of an 8 oz. bottle, an internally threaded collar 23 to fit over and make a liquid tight connection with the neck of a 5 oz. bottle and a connecting tube 24 joined at its ends to the collars 22 and 23. The adapter may readily be molded from suitable plastic by injection molding.

FIG. 5 illustrates another embodiment of the invention in which the tip 14*b* is solid and passageways are provided in the body 10*b* to supply the liquid from a squeeze bottle to the spreading means 5. Extending downwardly from the periphery of the body 10*b* is an integral collar 11*b* which is internally threaded to fit and make liquid tight engagement with the neck of an 8 oz. squeeze bottle. In this embodiment a brush 13*b* has its bristles secured in a removable back or base 26 which has a tight slip fit in a recess 25 in the mounting area 12b opposite the collar 11b. The recess 25, when the parts are assembled as shown, also constitutes a manifold liquid passageway connecting passageway 16b through the body 10b of the device with a suitable number of passageways and discharge orifices 27 through the base or back 26 of the brush 13b.

Instead of providing a separate adapter, as is illustrated in FIG. 4, the body 10b in FIG. 5 has a second integral collar 28 concentric with collar 11b which is internally threaded to fit and make liquid tight contact with the neck of a 5 oz. bottle. The area 17b within the collar 28 constitutes the area of the body 10b which is exposed to the contents of the squeeze bottle whether it is a 5 oz. or 8 oz. size.

FIG. 6 illustrates another embodiment of the invention which comprises a molded plastic body 10a having an integral collar 11c for making liquid tight connection with the neck of a squeeze bottle, a spreading means 5 in the form of a brush 13c, and a tip 14c having a passageway 15c therethrough communicating with a passage 16c leading to the area 17c of the body 10c. In this embodiment the mounting area 12c and the axis of the tip 14c make an obtuse angle with the axis of the collar 11c rather than a right angle as shown in FIGS. 1, 3, 4 and 5 and rather than a straight angle as shown in FIG. 2. This is accomplished by making the body 10c thicker on the side adjacent to the tip 14c than it is on the opposite side, as clearly seen in FIG. 6. The axis of tip 14c, however, lies in the plane through the midline of the mounting area 12c and a diameter of the collar 11c but the bristles of brush 13c while they lie adjacent to that plane are at an angle with respect to a plane through the axis of the collar at right angles to the plane through the axis of the tip. The angle is obtuse with respect to the plane below the brush and acute with respect to the plane above it. This obtuse angular relation permits an operator to cradle the sqeeze bottle in the hand at an angle where the weight is at least partially supported in the palm instead of being supported only by the friction of the gripping fingers and thumb. It is less tiring for an operator to hold the bottle on the angle, particularly when it is almost full of liquid, than to hold it vertically but otherwise the use of the device is essentially the same in both cases.

FIG. 7 illustrates an embodiment of the invention which enables an operator to make universal adjustment of the angle of the axis of the tip (a) to the axis of the attaching collar from the right angle of FIGS. 4 and 5 to the obtuse angle of FIG. 6, e.g., about 135°, and to an equidistant acute angle also, e.g., about 45°, (b) to the direction of the long dimension of the spreading means from the same direction to substantially a right angle to the back or to the front, and combinations thereof. This is accomplished by a ball and socket joint, e.g., by molding a recess 101 in the body 102 which is slightly over half a sphere and snapping into it in liquid tight contact a spherical end 103 of a tip 104. If movement in only one plane is desired, the recess 101 and end 103 could be cylindrical rather than spherical, as later described. A liquid passageway 105 extends through the tip from an orifice at or adjacent to the free end to an enlarged entrance port or funnel 106 of sufficient width to communicate with passageway 116 in body 102 at every angle of adjustment. Passageway 116 opens to the contents of a squeeze bottle through surface 117 which is surrounded by collar 111 to make liquid tight engagement with the neck of a squeeze bottle. The tip may be freely movable to all positions or there may be certain angles, e.g., 45°, 60°, 75°, 90°, 105°, 130° and 145°, where the tip is removably held, e.g., by a projection (not shown) on 103 in a recess (not shown) in 102 at each such angular position.

FIG. 7a shows an embodiment of the device similar to that illustrated in FIG. 7 in which the movable tip 104a has a knee type joint comprising a cylindrical end 103a in a somewhat more than semi-cylindrical recess and the passageway 105a extends from a discharge orifice at or near the free end of the tip 104a to a mid point in one end of the cylinder 103a. The body has two projections 107 and 108 extending outwardly at an end of the elongated mounting area to provide (1) a pivotal mounting for the cylinder 103a, permitting it a full 180° swing of tip 104a in a plane through the midline of the elongated mounting area, the axis of the tip and a diameter of collar 111a, and (2) a connection of passageway 105a with passageway 116a at all positions of angular relation of the tip to the axis of the collar.

The same structure may be used for movement in a plane parallel to 117. In order to hold tip 104a removably in any selected one of a plurality of angular relations to the axis of collar 111a, the end of cylinder 103a opposite passageway 105a may be provided with a detent 109 to fit in any one of several recesses 110 in the adjacent surface of projection 108.

In the embodiments of the invention illustrated in FIGS. 4, 4a, 5, 6, 7 and 7a the passageways for the liquid dispensed from a squeeze bottle attached to the respective devices terminate in a discharge orifice either at (FIGS. 4, 6, 7 and 7a) or adjacent to (FIG. 4a) the end of the tip, or in the mounting area at the base of the spreading means (FIG. 5). In the use of devices of these embodiments, if an operator, who has been using an embodiment that supplies the liquid through the tip, wishes to use one that supplies liquid adjacent to the spreading means, it is necessary in order to make this change to use both hands to remove the one device from the squeeze bottle and secure the other to it, and vice versa.

The invention also contemplates hair treatment devices which are capable of supplying liquid selectively through the tip and to the spreading means. This requires at least one passageway from the surface portion of the body of the device in contact with contents of a squeeze bottle to external discharge orifices, e.g., either a single passageway from said portion which has a branch going to the tip and a branch going to the mounting area, or separate passageways from said portion, one going to the tip and the other to the mounting area, respectively, with valve means under control of the operator for selectively connecting the area 17 of the body 10 which is in contact with the liquid in a squeeze bottle to which the device is attached either with the branch or passageway through the tip or with the branch or passageway leading to the base of the spreading means 5. Several embodiments of hair treatment devices having such valve means are illustrated in FIGS. 8 through 22b, 47 and 48.

Referring to the embodiment illustrated in FIGS. 8 and 9, the body 10d of the device is provided with a recess 29 in which is mounted a valve 30 that is rotatable on a horizontal axis aligned with or parallel to the axis of the tip 14d and parallel to the terminal plane of collar 11d. Valve 30 has a passageway 31 which, in one angular position with respect to the body 10d, connects the passageway 16*d* from the area 17*d* with the passageway 15*d* as clearly shown in FIG. 8. In this position of angular adjustment of the valve 30 with respect to the body 10*d* the device of FIG. 8 is the full equivalent of the device of FIG. 4 and it may be used in the same way already set forth in connection with the description of FIG. 4.

The body 10*d* is also provided with another passageway 32 from the area 17*d* which leads into the recess 29. On the other side of the recess 29 the body 10*d* is provided the passageway 33 connecting the recess 29 with a manifold passageway 25*d* like the passageways 16*b* and 25 already described in connection with the embodiment of the invention illustrated in FIG. 5. Valve 30 is provided with a second passageway 34 which is adapted, in another position of angular adjustment of valve 30 to body 10*d* different from the one which connects passageway 31 with 15*d* and 16*d*, to connect passageway 32 with passageway 33. This embodiment of the invention has separate passageways from the surface 17*d* in contact with the contents of a squeeze bottle to the orifice in the tip and to the orifices in the mounting area or the base of the spreading means 5.

In the position of angular adjustment of valve 30 which aligns passageways 32, 34 and 35, the device illustrated in FIG. 8 is the full equivalent of the device illustrated in FIG. 5, i.e., with the device of FIG. 8 so adjusted and secured in liquid tight relation to a squeeze bottle, the liquid contents in the bottle when squeezed will flow through the device to the passageways 27*d* and be discharged at the base of the spreading means 5, which may be a brush 13*d* as illustrated. The device may then be used in the manner described for the embodiment illustrated in FIG. 5.

In order to retain the valve 30 in its operative positions in recess 29 it is desirable to provide some retaining means for this purpose in addition to the friction resulting from the liquid tight fit of the valve 30 in the recess 29. One convenient means which is satisfactory is to provide a projection or detent 35 which may be either in the interior wall of the recess or in the cylindrical wall of the valve 30 with a corresponding groove in the other member. By making the parts out of somewhat yielding plastic they may be readily molded and assembled as shown. See FIGS. 8 and 8*a*.

A handle 36 is formed on the exposed end of the valve 30 to enable an operator to rotate the valve from the first mentioned position of angular adjustment to the second. As illustrated in FIGS. 8 and 9, the handle 36 is somewhat rectangular as viewed from the end (see FIG. 9) and arcuate as seen from the side (see FIG. 8). This is a desirable shape because it leaves no place in which hair could be caught during the use of the device.

It is advantageous also to provide indicia on the valve and the body of the device to apprise an operator what the position of angular adjustment of the valve is with respect to the body. FIG. 9 illustrates how visual indicia may be applied to the device. Thus a dot 37 may be formed on or applied to the valve adjacent to the periphery, e.g., near the lower end of the handle 36, and dots 38 and 39, respectively, may be formed on or applied to the collar 11*d* representing the positions of angular adjustment which directs the liquid from the squeeze bottle to the tip and to the brush, respectively. The initial T may similarly be formed on or applied to the collar 11*d* adjacent to the dot 38 representing the tip discharge position and the initial B adjacent to the dot 39 representing the brush discharge position, as seen in FIG. 9.

Other parts of the embodiment of the device illustrated in FIGS. 8 and 9 which are the same as previously described parts of other embodiments of the invention are not described again but for easy identification they have been given the same reference numbers plus the postscript "d".

In addition to, or in lieu of, the provision of external visual indicia on the exterior of the device to indicate the respective positions of the angular adjustment of valve 30 for tip and brush feed of the liquid from the squeeze bottle, internal physical means may also be provided which enable the operator to feel when each position has been reached during angular rotation of the valve. Such means may be referred to as physical or tactile means. This can be readily accomplished as shown in FIG. 8*a* by forming the groove for detent 35 so that it terminates in one direction when dot 37 is aligned with dot 38 and in the other direction when dot 37 is aligned with dot 39. The groove can also be made slightly deeper at these points to provide a recess into which the detent projects as seen in FIG. 8*a* so that slghtly greater force must be used to rotate the detent out of these recesses or deepened positions, thus enabling the operator to feel when the aligned position has been reached.

Another embodiment of the means for selectively directing fluid from the squeeze bottle through the device of the invention is illustrated in FIGS. 10 and 11 in which the body 10*e* is provided with a cylindrical recess 29*e* in the bottom surface to receive in fluid tight relation therein a valve 30*e* having downwardly projecting collars 28*e* and 111*e*, respectively, to receive the threaded necks of squeeze bottles of both the 5 and 8 oz. sizes. The valve 30*e* is rotatable within the recess 29*e* around an axis at a right angle or perpendicular to the terminal plane of collar 11*e* that forms recess 29*e*. The lower surface of the valve 30*e* within the collar 28*e* forms a surface 17*e* which is exposed to the contents of a squeeze bottle secured to the valve 30*e* as described, whether the squeeze bottle is of the 5 or 8 oz. size. Suitable means may be provided for positively retaining the valve 30*e* within the recess 29*e*, e.g., detent means 35*e* on either the valve or the flange 11*e* and a corresponding groove in the other part analogous to the detent 35 in FIG. 8. Valve 30*e* is provided with a passage 31*e* which may be aligned in one position of angular adjustment of 30*e* with respect to the body 10*e* with the passage 16*e* in the body 10*e* that connects with the passageway 15*e* through the tip 14*e*. This position of angular adjustment is illustrated in FIG. 10. In this position of angular adjustment the device of FIG. 10 is the full equivalent of the device of FIG. 4 and it may be used in the same manner already described in connection with FIG. 4.

In another position of angular adjustment of valve 30*e* with respect to body 10*e* passageway 34*e* in the valve 30*e* is aligned with passageway 33*e* in the body 10*e*, as illustrated in FIG. 11. In this second position of angular adjustment the device of FIG. 11 is the full equivalent of and it may be used in the manner already as the device illustrated in FIG. 5 which has already been described. In this position of angular adjustment, as seen in FIG. 11, the space within a squeeze bottle, whether of the 5 or 8 oz. size, communicates with the exterior through passageways 34*e*, 33*e*, 25*e* and 27*e*.

In the embodiment of the device illustrated in FIGS. 10 and 11 it is desirable to provide indicia to advise an operator what the position of angular adjustment of the valve 30*e* is with respect to the body 10*e*. A suitable way of providing visual indicia is to provide a window 40 in the collar 11*e* through which the periphery of the cylindrical valve 30*e* can be seen. The periphery of the valve 30*e* may have visual indicia (not shown) such as a dot and adjacent letter T at one position and a dot and letter B at a different position with a single dot on collar 11*e* with which the dots on the periphery of the valve 30*e* can be aligned when the passageways are arranged to discharge liquid to the tip and to the brush, respectively. While this is not specifically shown in the drawing it is analogous in all respects to the indicia provided in the embodiment illustrated in FIG. 9. Tactile indicia may also be provided with the detent 35*e* and its respective groove as described for detent 35.

The embodiment illustrated in FIGS. 10 and 11 is a second example of a device embodying the invention in which separate liquid passageways are provided from the surface of the body in contact with liquid in a squeeze bottle to discharge orifices in the tip and mounting area, respectively.

A further embodiment of the invention is illustrated in FIGS. 12, 13 and 14 in which the means for directing the liquid from a squeeze bottle to which the device is attached in fluid tight relation selectively either to the tip or to the spreading means comprises a valve 30*f* which is slidable in a recess 29*f* parallel to the terminal plane of collar 11*f* and on an axis at right angles to the axis of the tip 14*f*. In this embodiment the recess 29*f* is molded in the body 10*f* in which the valve 30*f* fits in liquid tight relation. At one position of endwise adjustment of the valve 30*f* in relation to the body 10*f* a passageway 31*f* provided in the valve connects the passageway 16*f* in the surface 17*f* inside the collar 28*f* with the passageway 15*f* in the tip 14*f* as illustrated in FIGS. 12 and 13. When the valve 30*f* is in this position of lengthwise adjustment the device of FIGS. 12 and 13 is the full equivalent of the device illustrated in FIG. 4 and it may be used in the same manner already described for the device illustrated in FIG. 4.

In another position of endwise adjustment of the valve 30*f* with respect to the body 10*f* a passageway 34*f* provided through the valve 30*f* becomes aligned with passageway 16*f* and passageway 33*f* which leads to the manifold 25*f* and in turn to the passageways 27*f* through the base or back 26*f* to the base of the brush 13*f*. In this position of endwise adjustment as illustrated in FIG. 14 the device of this embodiment is the full equivalent of and may be used in the same manner as already described for the device illustrated in FIG. 5.

It is desirable to provide some means for aligning valve slide 30*f* with the body 10*f* in the proper position of angular relation so that the passageways become aligned as described when the valve is moved lengthwise from one position of adjustment to the other. Any suitable means may be used, a convenient and satisfactory one being a projection or detent 35*f* on the valve slide or the body with a corresponding groove in the other part, as indicated in FIG. 12. The same tactile indicia (not shown) may be used for locating the two respective positions of endwise adjustment where the passageways are properly aligned to supply the liquid to the tip and brush, respectively, by deepening the groove at such positions so that an operator can feel by the resistance of the slide to movement when the aligned positions have been reached. This is quite analogous to the detent arrangement described in connection with FIG. 8. If desired visual indicia (not shown) comprising a letter T may be formed on or applied to the slide which is visible at the right side of the device as illustrated in FIG. 13 and a letter B can similarly be formed on or applied to the slide that becomes visible when it is moved in the direction of the arrow in FIG. 14 to the aligned position. The embodiment of the invention illustrated in FIGS. 12, 13 and 14 is one example in which a single passageway leaving the surface 17*f* of the body 10*f* has two branches, one leading to an orifice in the tip and another leading to the mounting area with the valve at the juncture selectively to control flow to one or the other outlet port.

A still further embodiment of means for controlling the discharge of the liquid from a squeeze bottle selectively either to an orifice in the tip or an orifice adjacent to the spreading means of a device of the invention is illustrated in FIGS. 15, 16 and 17 in which a valve 30*g* is provided for lengthwise movement in a direction perpendicular to the terminal plane of collar 11*g*. In this embodiment of the body 10*g* is enlarged on the side opposite the tip 14*g* far enough to make room for a recess 29*g* to receive the valve 30*g* in liquid tight relation. Desirably the valve 30*g* and body 10*g* have suitable means for holding them in a single position of angular adjustment which may be similar to the means provided in the embodiment illustrated in FIG. 12. Referring to FIG. 15 it will be seen that passageway 15*g* extends from the tip 14*g* through body 10*g* to the recess 29*g*, that passageway 33*g* extends from the manifold 25*g* to the recess 29*g* and that passageway 16*g* extends from the surface 17*g* out of alignment with passageway 15*g* to recess 29*g* at a position approximately equidistant between passageways 15*g* and 33*g*. Valve 30*g* is provided with a passageway 31*g* which, in one position of lengthwise adjustment, connects passageway 16*g* with passageway 15*g* as shown in FIG. 15. In this position of lengthwise adjustment of the valve 30*g* in recess 29*g* the device illustrated in FIG. 15 is the full equivalent of and may be used in the same manner already described for the device illustrated in FIG. 4.

In a second position of lengthwise adjustment of the valve 30*g* in recess 29*g* when the slide has been moved in the direction of the arrow shown in FIG. 16, the parts are brought into the position illustrated there with the passageway 31*g* aligned respectively with passageway 16*g* and passageway 33*g* which establishes communication between the interior of a squeeze bottle attached to the device with the discharge ports 27*g* adjacent to the spreading means (not shown). The device illustrated in FIG. 16 is the full equivalent of and it may be used in the same manner already described for the device illustrated in FIG. 5.

Valve 30*g* is provided with a further passageway 41 which, when placed in the position illustrated in FIG. 17 by further movement of the valve in direction of the arrow places passageway 16*b* in communication with both of the passageways 15*g* and 33*g*. While this connection is not ordinarily desired in hair treating operations for discharging liquids from a squeeze bottle simultaneously through the tip and to the spreading means, it is desirable for cleaning purposes to have such communication established so that by forcing water or other cleaning fluid through the passageway 16*b*, the passageways 15*g*, 33*g* and 27*g* can all be thoroughly cleaned simultaneously. Passageways similar to 41 may be provided for the embodiments of the invention illustrated in FIGS. 2, 2*a*, 8, 10 and 12 to provide for simultaneously cleaning all the passageways by forcing cleaning liquid through them as described for the embodiment illustrated in FIG. 17. Visual and tactile indicia may be provided for the valve 30*g* as described for valve 30*f* in the embodiment illustrated in FIGS. 12, 13 and 14 for positions T and B plus third indicia R for the rinse adjustment. The embodiment of the invention illustrated in FIGS. 15, 16 and 17 is a second example of a single liquid passageway from the surface of the body 10 of the device which divides into two branches leading, respectively, to a discharge orifice in the tip and a discharge orifice adjacent to the spreading device.

Another embodiment of means for selectively delivering liquid from a squeeze bottle attached to the device selectively to an orifice in the tip or to an orifice adjacent to the spreading means is illustrated in FIGS. 18 and 19 in which a slightly more than semicylindrical recess 29*h* is formed in the body 10*h* parallel to the terminal plane of collar 11*h* opposite the tip 14*h* and at right angles to the axis of tip 14*h*. In this embodiment, as in the embodiment illustrated in FIGS. 15, 16 and 17, passageways 15*h*, 16*h* and 33*h* extend to the recess 29*h*. A valve in the form of a cylinder flattened at one side and given reference numeral 30*h* is snapped into recess 29*h* in fluid tight relation to the body 10*h* and on the cylindrical surface opposite the flattened area a passageway 31*h* is provided which is of such dimensions that, in one position of angular adjustment, it connects passageways 15*h* and 16*h*, as illustrated in FIG. 18, and in another position of angular adjustment connects passageway 16*h* with passageway 33*h* which communicates with manifold 25*h* and exhaust ports 27*h*, as illustrated in FIG. 19.

With the valve 30*h* in the position of angular adjustment shown in FIG. 18, this device is the full equivalent of and it may be used in the same manner already described for the device illustrated in FIG. 4. Similarly with the valve 30*h* in the position of angular adjustment shown in FIG. 19, this embodiment of the device is the full equivalent of and it may be used in the same manner already described for the device illustrated in FIG. 5. Other parts of the device illustrated in FIGS. 18 and 19 which correspond with parts already described for the other embodiments are given like reference numerals with the postcript "h" and need not be further described. The embodiment of the device illustrated in FIGS. 18 and 19 may be provided with tactile or physical and/or visual indicia (not shown) to apprise an operator of the position of angular adjustment analogous to the indicia already described for the previously mentioned embodiments. The embodiment of the invention illustrated in FIGS. 18 and 19 is a third example of a hair treatment device having a single passageway leaving the area 17 of the body 10 with branches leading, respectively, to the discharge orifice in the tip and to the discharge orifice adjacent to the spreading means.

A further embodiment of the means for selectively directing liquid from a squeeze bottle secured to the device to a discharge orifice in the tip or to a discharge orifice adjacent to the spreading means is illustrated in FIGS. 20, 21, 22, 22*a* and 22*b* in which the valve body 10*i* is enlarged at the side opposite the tip 14*i* sufficiently to provide room for a recess 29*i* for a rotatable valve 30*i* placed in the recess in a liquid tight relation to the body 10*i*. Recess 29*i* is at right angles both to the axis of tip 14*i* and the terminal plane of collar 11*i*. A suitable handle 42 is connected with the valve 30*i* in any suitable way, e.g., by providing a recess in the valve into which the handle may be inserted by a pressure or adhesive fit, as shown in FIG. 20. The handle operates in a suitable window 40*i* in the body 10*i* which is of sufficient length to permit the angular movement of the valve 30*i* and handle 42 through the requisite number of degrees to move the valve to the various positions now to be described.

In this embodiment of the invention passageways 15*i* and 16*i* extend to the recess 29*i* and passageway 33*i* communicates with the upper end of the recess 29*i* which is closed at the top.

In a first position of angular adjustment of the valve 30*i* with respect to the body 10*i*, as illustrated in FIGS. 20 and 22*b*, passageway 31*i* formed in the periphery of the valve connects passageway 16*i* from the area 17*i* of the body 10*i* with the passageway 15*i* in the tip 14*i*. With the valve in this position of angular adjustment the device illustrated in FIG. 20 is the full equivalent of and it may be used in the same manner already described for the device illustrated in FIG. 4.

In another position of angular adjustment of the valve 30*i* by the handle 42, a passageway 43 is brought into alignment with passageway 16*i* and connects it with passageway 33*i* while the valve simultaneously closes the end of passageway 15*i* that extends into the recess 29*i*. In this position of angular adjustment the interior of a squeeze bottle secured to the device is placed in communication with the exterior through passageway 16*i*, passageway 43, passageway 33*i*, and manifold 25*i* and passageways 27*i*. In this position of angular adjustment the device illustrated in FIG. 21 is the full equivalent of and it may be used in the same manner already described for the device illustrated in FIG. 5.

Valve 30 may be also provided with a passageway 44 that is adapted simultaneously to connect passageway 16*i* with passageways 15*i* and 33*i*, as illustrated in FIG. 22. This position of angular adjustment of valve 30*i* is the equivalent of the position of lengthwise adjustment of the slide 30*g* illustrated in FIG. 17 and it may be used in the same way for simultaneously rinsing all of the passageways after each use of the device in a hair treating operation.

FIG. 22*a* illustrates a still further position of angular adjustment of valve 30*i* in relation to the body 10*i* of the device for a different purpose. A squeeze bottle makes a satisfactory vessel for mixing two or more materials which must be packaged separately for storage and which must be mixed shortly before application to the hair in a hair treating operation. Where a squeeze bottle is used for this purpose some means must be provided for closing the neck of the bottle so that it can be shaken vigorously to mix the material together without spilling. A fourth position of the valve 31*i* as illustrated in FIG. 22*a* provides an "off" position for the valve in which there is no free path for liquid through passageway 16*i* which satisfactorily retains the contents when the bottle is vigorously shaken. Without such an off position for the valve, the same results can be achieved by moving the valve to tip position, placing the forefinger over the discharge orifice near the end of the tip and shaking the bottle.

The ingredients used in some hair treating liquids react after they are mixed and form a gaseous by-product which must be vented from the container if undesired and even destructive high pressures within the container are to be avoided. In the embodiment illustrated in FIG. 22*a* a pressure relief valve is provided comprising a ball 46 which is urged by a spring 47 into pressure tight relation with a seat at the end of passageway 45 so that no fluid can exhaust from the container until the internal pressure overcomes the pressure generated by spring 47. An exit port 48 is provided below the spring 47 to permit such exhaust once the ball 46 is removed from its seat by the pressure of the fluid inside the system. Handle 42 is so located that an operator can readily move it from one position to another by a digit, e.g., the thumb, of the same hand that holds the squeeze bottle during use of the device.

All of the previously described embodiments of the invention may similarly be provided for the same purpose with a pressure release valve that may be located in any convenient place within the body 10 or the valve 30 associated with it.

Referring to FIG. 22*b*, which is a cross-section on a larger scale through the valve **30*i* and adjacent parts at the level of passageway 15*i*, the four described positions of angular adjustment of handle 42 are marked, respectively, T, indicating connection of the passageway 16*i* with passageway 15*i* leading to the tip, as shown in FIG. 20; B, indicating connection of the passageway 16*i* with passageway 33*i*** leading to the brush, as shown in FIG. 21; R, indicating the angular position shown in FIG. 22 for the rinsing operation; and O, indicating the position of angular adjustment shown in FIG. 22*a* which is the off position. These same visual indicia may be placed on the body **10*a* above the window 40*i* to apprise the operator of the position of angular adjustment of the valve 30*i* at any time. If desired physical indicia may also be provided in any suitable manner, e.g., as above described for the valve 30 in the embodiment illustrated in FIGS. 8 and 9**.

The device illustrated in FIGS. 20–22*a*. is a fifth example of the invention in which a single liquid passageway from the surface **17*i* divides into two branches, one leading to a discharge orifice in the tip 14*i* and the other to a discharge orifice adjacent to the spreading device 5**.

In the embodiments of the invention illustrated in FIGS. 5 and 8 through 22, in which liquid from a squeeze bottle to which the hair treatment device is attached is discharged through orifices adjacent to the spreading means 5, it is advantageous to correlate the effective size of the discharge orifices with the viscosity of the liquid for the same reasons that have been discussed in connection with the discharge of such liquids through the tip.

One expedient for accomplishing this purpose is to provide a plurality of removable brushes, such as shown in FIGS. 5 and 10 to 14, for each hair treatment device with the discharge apertures 27 of various diameters adapted to the viscosities of the different liquids to be discharged therethrough. Another but somewhat more expensive expedient is to provide a plurality of hair treatment devices each with discharge apertures 27 correlated with a single viscosity encountered with the hair treating liquids to be used.

A further and far less expensive expedient is illustrated in FIG. 23 which is an exploded perspective view of the embodiment of the invention illustrated in FIGS. 8 and 9 with the addition of a flow control plate 50. The shape and dimensions of plate 50 conform to the shape and dimensions of the recess **25*d* in the body 10*d* so that when the plate is inserted in the recess it has fluid tight contact with the walls of the recess. The only outlet for liquid flowing into the recess 25*d* through passageway 33 (see FIG. 8) is through apertures 51 in the plate 50. After the plate 50 has been placed in the recess 25*d* adjacent to the bottom wall thereof, the brush 13*d* is also placed in the recess 25*d* in fluid tight relation thereto. The dimensions of the parts are so related to each other that the lower edge of the back 26*d* is spaced from the plate 50 far enough to provide a manifold passage equivalent to 25*d* in FIG. 8 to all of the apertures 27*d* through the base 26*d* as already described. The invention contemplates the provision of a plurality of such plates 50 with each hair treatment unit, each plate having apertures of a size correlated with the viscosity of a particular solution which it is desired to distribute through the hair treatment device. The flow control plates 50** may be made of any suitable material, e.g., stainless steel, plastic, etc. and they are quite inexpensive regardless of the material from which they are made. This expedient is equally as satisfactory as the other expedients already described and it has the advantage of being much less expensive than either of the other described expedients.

FIG. 24 illustrates a different embodiment of removal brush using a dovetail connection rather than a slip connection of the type illustrated in FIG. 23. As seen in FIG. 24, the body **10*k* is provided with an elongated dovetail groove 55 in the mounting area 12*k* into which a dovetail projection 56 on the back 26*k* is adapted to fit in liquid tight relation. The floor of the groove 55 is provided with a slot 57 providing a manifold to conduct liquid from a passageway like the passageway 33 in FIG. 8 to all of the passageways through the base 26*k* like the passageways 27*d* through the base 26*d*. While such passageways are not shown in FIG. 24, they are the same as shown in FIG. 8. Similarly the recess 57 forms a manifold corresponding to the one shown in FIG. 8 at 25*d*. The embodiment illustrated in FIG. 24 may also be provided with flow control plates 50 as described for the embodiment illustrated in FIG. 23**.

In each of the embodiment of the invention illustrated in FIGS. 1, 3, 4, 5 and 7 through 24 the bristles of the brush constituting the liquid spreading means 5 have extended upwardly substantially parallel with the axis of the collars 11 as seen in both side and end views. While this is, generally speaking, the preferred direction for the fibers of the brush, in some instances it may be desirable to have these fibers angularly related to the axis of the collars 11 as illustrated in FIGS. 6 and 25. Thus the fibers of the brushes 13 as seen in FIGS. 4, 5, 8, 10, 11, 12, 18, 19, 20, 21, 22 and **22*a*** may be tilted to the right or left up to an angle of about 30° without significantly changing the operation of the hair treatment devices.

Similarly the direction of the bristles as seen from a position at right angles to the position of view in the figures just mentioned, viz., as seen in FIGS. 9, 13, 14 and 25, may be tilted to the right or the left at any desirable angle up to about 30°.

A convenient way of providing for bristles extending upwardly at an angle to the axis of the attaching collar is illustrated in FIG. 25 in which the base or back **26*m* is made thicker at one side than it is at the other. This causes the bristles which are secured to the base 26 perpendicular to the upper surface thereof to tilt from the axis of the collar at the same angle which a plane through the upper surface of the base 26*m* bears to the plane passing through the other side of the base which contacts the mounting area 12*m***.

The dovetail projection 56*m* which projects from the lower surface of the base 26*m* may be dimensioned and shaped so that either end of the brush 13*m* can be inserted into the dovetail slot 55*m*. This makes it convenient to tilt the bristles of the brush 13*m* to the right or the left as viewed in FIG. 25 by simply reversing the end which is inserted first into the slot 55*m*. This same expedient can be used with brushes that have a slip connection with the body of the hair treatment device and in any of the embodiments where a removable back is not provided the bristles may be angularly secured initially in the mounting area 12 at an angle to the axis of the collar 11. The back may also be made in cylindrical form and secured in a somewhat more than half cylindrical recess in the mounting area in substantially the same way that the valve 30*h* is secured in recess 29*h*. This enables an operator to adjust the brush to any desired angular relation to the axis of the collar 11 as viewed from the end and, if desired, detent means may be provided for such a brush base to hold it removably in a plurality of different angular positions as already described for the valve 30*h*.

Rotation of the valve 30 in the embodiments of the invention illustrated in FIGS. 8 and 9, 23 and 24 requires the use of two hands, one to hold the hair treatment unit, usually by means of a squeeze bottle secured thereto, and one hand to grip the handle 36 between the tumb and the forefinger. The valve 30 can easily be modified to provide for rotation with the tumb of the hand that holds the hair treatment device by extending the handle 36 to provide a lever 60 as illustrated in FIG. 25.

Referring now to FIG. 26, the hair treatment device 1 of the type illustrated in FIG. 8 is shown secured to a squeeze bottle 2 in liquid tight relation in the upside-down position ready for use to part the hair with tip 14*d*, supply liquid from the squeeze bottle to the tress formed in the parting operation either by way of passageway 15*d* through the tip 14*d* or by way of passageway 33 to the base of the spreading means 5, shown as a brush 13*d*, depending upon the angular adjustment of valve 30 with respect to the body 10*d*. In this embodiment of the invention the tip 14*d* is in the shape of a frustum, being smaller in cross-section at the free end than it is at the end connected to the body 10*d*. Because of this shape it is relatively easy, when using the tip to form a tress, for hair adjacent to the free end to slip off the tip, particularly when the device is in the hands of an inexperienced operator.

FIG. 27 illustrates an embodiment of my invention which overcomes the tendency of hair to slip easily off the end of the tip by providing the tip 14*n* with a lateral projection or enlargement 62 to form a cradle between the free end of the tip and the body 10*n* of the hair treatment device. The passageway 15*n* through the tip 14*n* may be curved at the end, as previously described in connection with the embodiment illustrated in FIG. 7, so that the liquid discharged through passageway 15*n* is given a component of motion in the direction that it will subsequently be spread by spreading means 5.

In FIGS. 26 and 27 the axis of the tips is substantially at right angles to the axis of the collars. The cradling effect of the projection 62 can be increased, if desired, by changing the axis of the tip as illustrated in FIG. 28. In this embodiment the axis of the tip 14*p* is at an acute angle to the axis of the collar 11*p* and thus differs from the embodiment illustrated in FIG. 6 in which the angle of the axis of the tip 14*c* is obtuse with respect to the axis of the collar 11*c*. The increased cradling effect obtained by changing the angle of the axis of the tip with respect to the axis of the collar can also be obtained by the expedient illustrated in FIG. 29 utilizing the hair treatment device illustrated in FIG. 27 together with an adapter 65. One end of the adapter is in the form of a collar 66 having an internal thread to receive the neck of squeeze bottle 2 in liquid tight relation. The other end 67 has an external thread corresponding to the neck thread on squeeze bottle 2 and it is adapted to make liquid tight contact with the device 1 by means of the internally threaded collar 11*n*. Connecting these two ends of the adapter 65 in a tube 68 which is much shorter on the side adjacent to the tip 14*n* than it is on the opposite side which tilts the axis of the tip 14*n* at an acute angle with respect to the axis of the collar 66. Adapters may be made, however, to provide any desired angular relation between the axis of the tip and the axis of the squeeze bottle. Thus, for example, an adapter to hold the tip 14 of device 10 at an obtuse angle such as that illustrated in FIG. 6 may be provided by the simple expedient of making the length of the tube 68 adjacent to the tip long with respect to the length of the tube on the opposite side, thus reversing the angular tilt from the acute angle of FIG. 29 to the obtuse angle of FIG. 6. Any desired angle between the smallest acute angle to the largest obtuse angle can be achieved by simply adjusting the lengths of the sides of tube 68 adjacent to and opposite from the tip. In all cases it is preferred to have the tips lie in a plane through the midline of the spreading means and a diameter of the collar.

In some cases it is convenient, as in hair shading, for example, to employ a hair treatment device which is capable of dispensing and spreading liquids from a plurality of different sources. The embodiment of my invention illustrated in FIGS. 30 and 30*a* provides such a device 1*q* for a squeeze bottle 2*q* that is divided into two parallel containers or compartments 69 and 69' by a partition 70. Device 1*q* includes an elongated spreading means comprising two separated parts 5 and 5' capable of separate use in spreading treating liquid. Each part is aligned with the other and they extend in the same general directions as two tips 14*q* and 71 which are secured at one end to the body adjacent to parts 5 and 5', respectively. Device 1*q* has a plurality of discharge orifices in its exterior, preferably one orifice 15*q* in tip 14*q*, as at the free end or adjacent thereto, one orifice 72 in tip 71, as at the free end or adjacent thereto, and at least one orifice 27*q* for part 5 and 27*q'* for part 5' of the spreading means. Means for discharging liquid from the squeeze bottle 2*q* selectively from any one of said orifices may comprise a valve 30*q* very similar to the valve 30*e* in the embodiment of my invention illustrated in FIGS. 10 and 11. The valve 30*q* includes an internally threaded collar 111*q* to receive the neck of the squeeze bottle 2*q* in liquid tight relation not only to the neck of the squeeze bottle but with respect also to the partition 70 which bears tightly against the surface 17*q* within the internally threaded collar 111*q*. Collar 11*q* of the body 1*q* forms a liquid tight fit over the valve 30*q* and they may be held together by means of one or more projections 35*q* in the same manner that the projection 35*e* serves to keep the parts together in the embodiment illustrated in FIGS. 10 and 11 as already described. Valve 30*q* is provided with apertures or passageways 31*q* and 34*q* which communicate with compartment 69 and passageways 31*q'* and 34*q'* which communicate with compartment 69'.

In a first position of angular adjustment of the body 10q with respect to the valve 30q passageway 31q may be aligned with passageway 16q which communicates with the passageway 15q going through the tip 14q to the free end thereof, as seen at the left side of FIG. 30.

In a second position of angular adjustment of body 10q with respect to valve 30q passageway 34q may be aligned with a passageway 33q leading to a manifold 25q that connects with a plurality of passageways and discharge orifices 27q for supplying liquid to spreading means 5, e.g., a brush 13q.

The other tip 71, advantageously axially aligned with tip 14q, has a liquid passageway 72 which extends through it to a transverse passage 73 in the body 10q. In a third position of angular adjustment of body 10q with respect to valve 30q passageway 31q' may be aligned with passageway 73.

In a fourth position of angular adjustment of body 10q with respect to valve 30q passageway 34q' may be aligned with a passageway 33q' leading to a manifold 25q' that connects with a plurality of passageways and discharge orifices 27q' for supplying lqiuid to spreading means 5', e.g., a brush 13q'.

The relative movement of body 10q with respect to valve 30q from the first to the second position of angular adjustment to align 33q and 34q simultaneously breaks the alignment of passageways 16q and 31q.

Similarly the relative movement of body 10q with respect to valve 30q from the second to the third position, and from the third to the fourth position, of angular adjustment simultaneously breaks the alignment of passageways 33q and 34q, and of passageways 31q and 73, respectively. Thus liquid may be dispensed from the device 1q from only one discharge orifice at any given time through orifices 31q, 31q', 34q or 34q'. If a rinse position is desired, however, that would permit liquid to flow to all discharge orifices at once, a line of four additional passageways can be provided in surface 17q that align, in a fifth position of angular adjustment, all four such passageways simultaneously with passageways 16q, 33q, 33q' and 73, respectively.

By properly spacing all the various passageways in surface 17q, an "off" position for all the discharge orifices can be provided when the body 10q is at some intermediate position between any two aligned positions. It may be noted, however, that both passageways leading from one compartment 69 or 69' are closed when the valve is in a position of angular adjustment to dispense from either passageway from the other compartment.

It will be apparent from the foregoing description that with the parts arranged in the alignment disclosed in FIG. 30 an operator can use the tip 14q to part the hair to form a tress or strand which is to be treated with the liquid in compartment 69. The liquid may be forced out through the tip 14q by squeezing the bottle in the usual way. The liquid so discharged may then be spread with the spreading means 5. Or, if the operator prefers to dispense the liquid through orifice 27q adjacent to the brush 13q, the valve and body may be moved to the second position of angular adjustment to align passageway 33q and 34q. Similarly, the tip 71 can be used to make the parting and the angular relation of the valve 30q with respect to the body 10q may be adjusted to align passageways 31q' and 74 or 33q' and 34q' to dispense the liquid in compartment 69' either through the tip 71 from opening 72 or through orifices 27q' and this liquid can then be spread on the hair by the spreading means 5'.

One situation in which the device of FIG. 30 is highly advantageous arises where a customer desires a plural-hue toning, now frequently referred to in the art as hair painting, hair shading, and dimensional coloring, e.g., a light ash blond portion and a darker ash blond portion. The two different toners would be placed in the two compartments, respectively, and the valve adjusted initially to dispense one or the other through either the tip or the orifices adjacent to the spreading means connected to that compartment. Then when that toner from that compartment has been used on the portions of the hair to be treated with it, the valve can be adjusted to dispense the other liquid from the other compartment of the container through either the tip or the orifices adjacent to the spreading means connected to said other compartment. In many cases the liquids are not readily distinguished by sight so it is contemplated to provide indicia to apprise the operator which tip or spreading means is dispensing one liquid and which tip or spreading means is dispensing the other. Indicia of the type referred to above are quite satisfactory for this purpose, e.g., the letters LT in the position where the lighter toner is dispensed through a tip, the letters LB in the position where the lighter toner is dispensed at the spreading means or brush, the letters DT in the position where the darker toner is dispensed through the tip and DB in the position where the darker toner is dispensed at the spreading means or brush. Also one tip can have a lighter color and the other a darker hue, e.g., by forming at least one tip with a removable joint as shown in FIG. 7 or FIG. 7a, or by a different shape, length, etc., or by appropriate marking on the bottle itself. Similarly visual indicia may be provided for "off" and/or rinse positions, and tactile indicia, e.g., depressions to receive projections 35q, may also be provided.

It has been pointed out above that the normal position of a hair treatment unit of the present invention is that shown in FIG. 3 with the spreading device at the top. This is not only the normal position for the unit detached from a squeeze bottle but also for the combination unit when the device is secured in liquid tight relation to the neck of the squeeze bottle since squeeze bottles have a flat bottom on which they can rest with the bottle in upright position and with the neck at the top. This, however, is opposite to the upside-down or working position of the unit and it is desirable in some instances to avoid the necessity for reversing the position of the device every time the operator has to set it down. My invention contemplates the provision of support means to hold a combination unit in the upside-down or working position when it is rested on a surface and a convenient means for accomplishing this purpose is disclosed in FIG. 31. In this embodiment a squeeze bottle 2r is secured in liquid tight relation to a hair treatment device comprising a body 10r and a tip 14r extending outwardly on an axis substantially at right angles to the axis of the squeeze bottle 2r. As seen in FIG. 31, the spreading device 5 is now at the bottom rather than at the top. A suitable stand for holding the squeeze bottle in this position with the spreading device 5 out of contact with the surface on which the stand rests comprises a split sleeve 76 which by its natural resiliency embraces the squeeze bottle tightly enough to generate sufficient friction that the weight of the entire unit when the bottle is full is insufficient to cause the sleeve to move relative to the exterior wall of the squeeze bottle when the sleeve is pushed out to the position shown in FIG. 31 as a support for the unit. The free ends of the sleeve are far enough apart to permit the tip to move through the space between these ends and in order to preserve the alignment of the space between the ends of the sleeve with the tip of the hair treatment device the wall of the squeeze bottle 2 may be provided with guide ribs 77 extending outwardly into the space between the free ends of the split sleeve as clearly shown in FIG. 31. The sleeve 76 can be moved by the operator to a position entirely over the wall of the squeeze bottle when the hair treatment device is in use where it does not interfere at all with the normal operation of the squeeze bottle yet is instantly available for use as support by simply moving it outwardly to the position shown in FIG. 31.

Another embodiment of the invention using a squeeze bottle adapted to contain two different hair treating liquids and to be used in much the same way as the embodiment illustrated in FIG. 30 is illustrated in FIG. 32 in which a squeeze bottle 2*s* is separated by a transverse partition 70*s* at an intermediate position between the ends into two compartments each of which is provided with a neck of the usual size and structure. A hair treatment device 1*a* is secured to each neck in liquid tight relation thereto which has the same structure as the device illustrated in FIG. 2 which will now be more particularly described.

In the embodiment of FIG. 2 a body 10*s* has a collar 11*s* forming a recess which receives a rotatable valve 30*s*, substantially like the valve 30*e* in the embodiment of the invention illustrated in FIG. 10, including an outwardly extending collar 111*s* internally threaded to receive and form a liquid tight connection with the threaded neck of a squeeze bottle 2*a*. The end wall of the valve 30*s* from the periphery of which collar 111*s* projects includes the surface area 17*s* surrounded by collar 111*s* which is exposed to the contents of a squeeze bottle when it is screwed onto the valve 30*s*. The body 10*s* may be secure against easy endwise removal from valve 30*s* by a projection 35*s* analogous to the projection 35*e* in the embodiment illustrated in FIGS. 10 and 11. The end wall bearing surface 17*s* is provided with two passageways or apertures 31*s* and 34*s*. Passage 31*s* is adapted, in one position or angular relation of body 10*s* to valve 30*s*, to be aligned with the transverse branch 16*s* of a passage 15*s* through the tip 4*a*. Passage 34*s* is adapted to be aligned in a different position of angular relation of the body 10*s* to the valve 30*s* with a manifold passage 25*s* which makes connection with a plurality of passages 27*s* leading to discharge orifices in the exterior of the device 1*a* in the mounting area 12*s* adjacent to the base of the spreading device 5*a* which may be in the form of a brush 13*s*.

The device illustrated in FIG. 2 may be provided with physical and visual indicia such as already described for the embodiment illustrated in FIGS. 10 and 11 to apprise the operator of the relative angular relationship between the body 10*s* and the valve 30*s*, e.g., deeper recesses for the projection 35*s* in the positions where the apertures 31*s* and 34*s* are aligned with their respective discharge passageways as physical indicia and visual indicia such as letters T and B to indicate the alignment of 31*s* with passage 16*s* and the alignment of passage 34*s* with 25*s*, respectively. Valve 30*s* may also have rinse and off positions such as described for the device of FIG. 30.

The relation of tip 4*a* to spreading means 5*a* in FIG. 2 is the same as described for tip 4 and spreading means 5 in FIG. 1, i.e., the axis of tip 4*a* is in a plane passing through the midline of the mounting area 12*s* for brush 13*s* and a diameter of collar 11*s*. The end of collar 11*s* lies in a plane at right angles to the axis of the collar. In FIG. 2, however, the mounting area 12*s* is on the side of body 10*s* which is adjacent to the side carrying collar 11*s* and the axis of the tip 4*a* is aligned with or parallel to the axis of collar 11*s* and at right angles to the terminal plane through the free end of collar 11*s*.

FIG. 2*a* illustrates an embodiment of the invention capable of performing the same functions in substantially the same manner as the embodiment illustrated in FIG. 2 but by somewhat different means. In FIG. 2*a* the body 10*z* is a molded plastic piece having a base cylinder of the diameter necessary to provide a peripheral collar 11*z* to make liquid tight contact with the neck of an 8 oz. squeeze bottle. A second collar 28*z* to fit the neck of a 5 oz. squeeze bottle may also be intergrally molded with the base concentric with collar 11*z* and around a space 17*z* that will be in contact with liquid in an 8 oz. or a 5 oz. squeeze bottle. Integrally molded on the body 10*z* on the side opposite the collars 11*z* and 28*z* is a relatively long projection having a smaller cylindrical portion adjacent to the body 10*z* of about the same length as and about half the outer diameter of collar 11*z* and beyond that a tapered portion forming a tip 14*z*. Rotatably mounted in liquid tight relation on the smaller cylindrical portion is a generally cylindrical valve 30*z* having a raised mounting area 12*z* axially arranged on its periphery. Spreading means 5*a*, e.g., a brush 13*z*, is secured to the mounting area in any of the ways previously disclosed herein. A liquid passageway 15*z* is formed in tip 14*z* which extends from a discharge orifice in or adjacent to the free end to a position within the smaller cylindrical portion where it terminates at the periphery thereof. A second liquid passageway 16*z* originates at surface 17*z* and extends toward passageway 15*z* and then outwardly to the periphery of the smaller cylinder where it terminates in a position adjacent to the terminus of passageway 15*z*. In the inner wall of valve 30*z* is a connecting passage 31*z* adapted, in one angular position of 30*z* with respect to body 10*z*, to connect the terminus of passageway 15*z* with the terminus of passageway 16*z* and thus enable liquid from a squeeze bottle secured to body 10*z* to be dispensed through the tip 14*z*. In another position of angular adjustment of valve 30*z* with respect to body 10*z* a passageway 33*z* in valve 30*z* is brought into registry with the terminus of passageway 16*z*. Passageway 33*z* connects with manifold passageway 25*z* in valve 30*z* which connects in turn with a plurality of passageways 27*z* having discharge orifices in the mounting area 12*z* adjacent to the base of the bristles making the brush 13*z*. In this position of valve 30*z* with respect to body 10*z* with 33*z* and 16*z* aligned, liquid forced form a squeeze bottle attached to body 10*z* will flow through passageways 16*z*, 33*z* and 27*z* to the base of spreading means 5*a* for application to a tress of hair formed by use of tip 14*z* in the manner previously described.

The valve 30*z* may be provided with means to maintain it in proper position on the smaller cylinder, e.g., a detent (not shown) on one part and a groove on the other which may also provide physical indicia of the respective aligned positions of the valve with the body, in the manner described for the embodiment illustrated in FIGS. 10 and 11. Visual indicia similar to those used for the device illustrated in FIG. 10 may be used on the periphery of body 10*z* and the periphery of part 30*z*.

The device of the present invention may be made in any suitable and desirable way. The method of making the device is not part of the present invention. A desirable way of making the plastic parts is by injection molding with which those skilled in the art are familiar and by designing the molds to proper dimensions taking into consideration the shrinkage coefficient of the plastic being molded, it is possible to mold the parts to the precise dimensions needed for liquid tight but movable contact. Many plastics that are suitable for the molded parts are sufficiently elastic to permit withdrawal of core pieces from a recess in the molded body even though it has a projection to form a depression or a depression to form a projection on the body formed against it so that it is unnecessary to carry out machining operations on the molded bodies. The tines and/or bristles necessary for one of the general types of liquid spreading means disclosed may be formed in the same injection molding operation as the body (especially the tines) or they may be performed and set into the plastic body when it is molded. Generally speaking, however, when a brush is used it is preferred to set the bristles in a back or base in a separate operation and then either mold the body around the base or provide a recess in the body into which the base is latter pressed and held either by friction alone, or by interlocks such as detents and recesses for them, or by adhesives, by heat sealing, solvent sealing, and the like.

Referring again to FIG. 32, although the squeeze bottle 2*s* having the two different compartments arranged in tandum at each side of partition 70*s* is shown with a hair treatment device 1*a* of the type just described, any of the other embodiments of hair treatment devices illustrated in FIGS. 8 to 29 may be used and it is not essential that the device on one end be identical with the device on the other end. This type of squeeze bottle may also be provided with a sleeve similar to that shown at 76 in FIG. 31 for removably holding the device in upright position on a support surface or, as may be preferred in some instances, a separate support 80 may be provided which is in the form of an inverted cup having a support skirt 81 and an apertured top surface 82 in which the aperture 83 is large enough to let the hair treatment device 1*a* pass through it and small enough to support the shoulder of the squeeze bottle as clearly illustrated in FIG. 32.

FIGS. 33 and 34 illustrate a useful embodiment of the present invention for dispensing hair treating materials from a separate package in the form of a manipulatable container 85, e.g., a thin walled plastic container, having an outlet secured to a flexible washer or annulus 86. In preparing the package for storage, shipment and the like, as illustrated in FIG. 34, a closure plate 87 is secured to the annulus 86 in liquid tight relation, e.g., by a heat seal or adhesive seal which can be broken when the time comes for removing the closure and placing the container 85 in a squeeze bottle. Since it may be somewhat difficult to insert the bag or container 85 through the neck into a plastic squeeze bottle of the type described hereinabove, a special type of squeeze bottle illustrated in FIG. 33 may be provided having a base section 2*t* of uniform diameter having an external thread at the top end to engage with a neck adapter 88 comprising a collar 89 at one end which is internally threaded to make liquid tight contact with the open threaded end of a squeeze bottle 2*t*, an externally threaded neck 90 at the opposite end which is like the neck of the conventional commercial squeeze bottle and an intermediate shouldered connecting tube 91 for the two ends which makes the overall appearance of the assembled device very similar to the overall contour of a squeeze bottle of the same dimensions. As seen in FIG. 33, the washer or annulus 86 is adapted to rest on the end of the neck 90 and it may be easily assembled in this relation before the adapter is secured to the squeeze bottle 2*t* by slightly deforming the washer 86, pushing it upwardly through the adapter 88 and then arranging it on the end of the neck 90 as shown. Then with the container 85 suspended by the adapter 88, it may be dropped down into the open end of squeeze bottle 2*t* into which it readily fits because of the uniform diameter of the cylindrical wall thereof, whereupon the adapter 88 and squeeze bottle 2*t* may be screwed together in liquid tight relation as shown in FIG. 33.

After assemblage of these parts the closure member 87 can be stripped from the washer 86, a hair treatment device of any type, e.g., a type 1 or type 2, may then be screwed onto the threaded end 90, bearing against the washer 86 with a surface 17 so as to make fluid tight connection of the thin wall container 85 with the hair treatment device. The combined unit is then ready for use in the same manner as a unit in which the contents are in a squeeze bottle itself as already described. Two such containers 85 of suitable dimensions may also be used within a squeeze bottle to constitute a two compartment container for the purposes of devices illustrated in FIGS. 30 and 32.

In order to discharge materials fully from the thin walled container it is convenient to provide a check valve to build up additional pressure between the squeeze bottle and the enclosed container 85 with each dispensing squeeze on the bottle. A simple check valve comprises a hole 92, e.g., in the bottom wall of the bottle, covered by a soft rubber flap 93 secured by one end to the interior surface adjacent to the hole with the other end covering the hole, as seen in FIG. 33. This flap closes the hole when the bottle is squeezed to expel liquid but air flows in to fill the void left by liquid expelled when the squeezing pressure is released. This goes on each squeeze until bag 85 is empty.

Where two materials used in hair treating are reactive they need to be mixed just prior to use so as to minimize reaction between them. A means for packaging the ingredients separated from each other, mixing them and then dispensing the mixture in accordance with this aspect of the invention is illustrated in FIG. 34 which comprises an inner container 94 enclosing one of the materials, preferably a liquid, placed bodily within an outer container 85 which also contains the other material needed in the hair treating operation, e.g., a powder. The inner container 94 must be rupturable to permit the liquid pacakged in it to flow out when manipulated. It may be provided, for example, with a weakened wall area 95 so that when substantial pressure is put on the interior container, for example by squeezing the lower end of the outer container 85 tightly, the inner container 94 will rupture at the weakened area 95 and discharge its contents into the material already in the container 85. By squishing the contents around in the container 85 by digital pressure on various parts along the length thereof a very good mixing operation can be carried out. The container 85 can be assembled for use of the mixture therein with the squeeze bottle 2*t* at the hair treatment device as previously described. In such case it is desirable to secure the inner container to the outer container so that it does not rise to the top and clog the outlet passage or passages. If preferred, the mixture in the outer container may be expelled into an ordinary squeeze bottle for use as described above with any of the hair treatment devices. In any event, the mixing of the materials in this way brings the contents that were packaged in the dual containers 85 and 94 in thoroughly mixed condition in a very short time and in ideal for use in a hair treating operation.

Where a hygroscopic powder in the outer container makes contact with the wall of the inner container in which a reactive liquid is present, as the embodiment of the invention just described contemplates, the material of which the inner container is made must provide a barrier to the passage of moisture from the inside to the powder outside. Otherwise premature reaction occurs with serious disadvantages including loss of potency, short shelf like and caking of the powder. Some thin walled plastics serve as a permeable or semipermeable membrane under these conditions and therefore may not be satisfactory materials for the inner container in simple sheet, tube or like form but they may be used in laminates. For example, polyethylene film is unsatisfactory as a thin walled container for a liquid with a reactive powder against the outer surface because it is pervious thereto but as a heat sealable coating on both sides of an impervious sheet, e.g., aluminum foil, a flexible laminate is provided which is readily made in pouch form by a heat seal around the edges as shown in FIG. 52 and which retains moisture satisfactorily for many months, even years. The same type of laminate, i.e., a layer of impervious metal foil with an adherent layer of heat sealable plastic on both sides, may also be used for the outer container where passage of moisture from the atmosphere through the wall of the container would cause deterioration of the contents. Where this is not a problem it is usually not necessary to make the outer container of a laminate and a film of plastic, such as polyethylene, polypropylene and the like may serve satisfactorily.

Referring now more particularly to FIG. 52, the package 320 is made from a sheet 321 of laminate such as that just described, e.g., a sheet of aluminum foil having a layer of polyethylene on each surface. Packages of this general type are known and the conventional way of making them comprises pulling a strip of the laminate over a folder that forms it into V-shape, heat sealing the bottom and sides to form successive compartments, introducing the contents into the open top and heat sealing the top. The individual envelopes or packages are severed either at the stage immediately after the side seals are formed, in which case they are carried by clips on an endless chain to the other stations, or after filling and top sealing. This same procedure can be followed in making packages 320 with the modification that the strip of laminate 21 has applied thereto at proper intervals a band 323 of adhesive material that forms a barrier between the adjacent compartments that will not be broken during manufacture, storage and shipping but will open up when substantial pressure is exerted against the surfaces of the compartment containing the liquid. Such adhesive materials are known in the art and includes pressure sensitive adhesives, a strip on one side being sufficient, contact adhesives which require a strip on each side, and the like. In using this modified strip material it would be pulled off in the usual way, folded to V-shape and heat sealed along the bottom and sides. At the same time pressure would be applied to seal band 323 and thus form a two compartment container into one of which a powder would be introduced and into the other a liquid. Then the top would be heat sealed, forming the complete package 320 with side walls 321, a peripheral heat seal 322 and a rupturable seal 323. In forming the peripheral heat seal a teat 324 can be left in any convenient location to serve as a discharge orifice when cut off after the ingredients are mixed by manipulation of the package.

Instead of an adhesive seal 323, the invention contemplates a different form of rupturable seal such as illustrated in FIG. 53 in which the package 330 comprises a sheet of laminate 331 such as previously described which may be heat sealed peripherally and centrally at 332, leaving a teat 334 for dispensing the contents when snipped off. Across the central heat seal is a nozzle 335 of brittle plastic, such as used on individual throw-away salt and pepper packages, that will break off when subjected to bending stress. As shown in FIG. 54 this nozzle may advantageously be made in diamond shape to blend easily into the laminate and form a liquid tight but rupturable barrier between the two compartments of the container. A convenient way of modifying the conventional machinery for making this package 330 is to add a station before the first heat seal station at which a nozzle is placed in proper position and heat sealed to the inner polyethylene layer on one side which then holds it while the laminate is moved into the heat sealed station where the bottom, side and central heat scals are made. It is necessary only to modify the central heating irons to fit around nozzle 335 so as not to crush it. The remaining operations to complete package 330 may be as set forth for package 320. After heat sealing, as seen in FIG. 54, the barrier between the two compartments comprises two exposed layers 336 of polyethylene, two layers of aluminum foil 337, a blended layer 338 at each side of the nozzle 335 and a divided layer 340 on and heat sealed to the nozzle 335.

In using a package 330 for mixing the contents of the separate compartments, an operator would subject the nozzle 335 to bending stress which would break it open but not produce loose fragments. The liquid would then be forced by pressure from the left compartment into the right, as seen in FIG. 53, which would contain the powder or other material to be mixed therewith. Manipulation of the package 330 results in thorough mixing of the ingredients whereupon the mixture can readily be transferred to a squeeze bottle by snipping off teat 334.

FIGS. 35 to 38 illustrate various embodiments of slender, elongated, upwardly extending members that may constitute the spreading device 5 contemplated by the present invention. The spreading device illustrated in FIG. 35 is essentially the same as the one illustrated in the embodiment of FIG. 5 comprising a brush **13*u* having bristles as set in a base 26*u* but with the addition of a row of comb tines 96 adjacent to but at one side of the brush 13*u*. Such tines may have any desired length with respect to the length of bristles of the brush, e.g., the comb tines 96 may be about ¼ as long as the bristles 13*u* in FIG. 35, or tines 96*v* may be about half as long as the bristles 13*v* as seen in FIG. 36, or the bristles 13*w* may be considerably shorter while the tines 95*w* are longer, e.g., the bristles may be about ¼ as long as the tines, as seen in FIG. 37. In the embodiment of FIG. 38 the spreading device consists entirely of tines 96*x*** forming a comb without any bristles at all. Tines pass through the hair somewhat more readily than bristles of a brush and tend to unsnarl hair considerably more readily that it is possible to do with a brush. On the other hand, tines are a less efficient means for spreading liquids through the hairs of a strand or tress but both can be used satisfactorily for this purpose with sufficient attention and care by an operator.

FIGS. 39 to 42 illustrate different embodiments of discharge orifices for supplying treating liquid to the base of the spreading means 5. In FIGS. 39, 40 and 41 a single row of tufts of bristles 13 is provided along the midline of the base 26. In FIG. 39 two rows of orifices 27 are provided, one on each side of the row of tufts and adjacent to the spaces between them. These holes may be of various sizes in different spreading devices made in accordance with this embodiment of the invention so as to correlate with the viscosities of liquids to be dispensed therefrom, or any of these spreading devices having a single size of orifices may be used in conjunction with a plurality of control plates 50, as illustrated and described in conjunction with FIG. 23.

FIG. 40 differs from FIG. 39 in that a single row of apertures 27 is provided which is aligned with the tufts of bristles 13. This form of invention might be used for liquids that are less viscous than those for which a device built in accordance with the disclosure of FIG. 39 might be used.

FIG. 41 differs from FIG. 40 in the elongation of the apertures 27 to provide a greater total discharge area than that of FIG. 40. The embodiment of FIG. 41 might be used with more viscous fluids than the embodiment of FIG. 40.

In FIGS. 42 and 43 the spreading device 5 comprises two rows of tufts of bristles 13 and an elongated slot 27 between them for discharge of the liquid. The width and length of the slot may be adjusted so that the discharge area conforms to the requirements imposed on the system by the viscosity of the liquid to be discharged. The embodiment of FIG. 43 differs from that of 42 only by providing enlargements in the center discharge slot opposite the spaced between the tufts of bristles which thus enlarges the discharge area and would permit the uses of this embodiment of the device for discharging more viscous fluid than might be discharged satisfactorily through the slot 27 in the modification illustrated in FIG. 42.

The various patterns of bristles and discharge openings illustrated in FIGS. 39 to 43 are not to be construed as exclusive but rather as indicative of satisfactory forms of discharge openings and tuft arrangements.

FIG. 44 illustrates an embodiment of the invention having a different type of spreading device 5 in the form of an elongated roller 97 mounted on a shaft 98 journaled in the body 10*y* in a recess 25*y* aligned with the axis of the trip 14*y*. The length of the roller is of the order of the three times the diameter thereof and the cylindrical surface of the roller is preferably provided with circumferential projections 99 giving a ridged or grooved effect. The purpose of the projections and grooves is to enable the spreading device to penetrate into a strand of hair when the device is moved outwardly along a strand in a direction transverse to the axis of the tip 14*y*.

A grooved spreading roller such as that illustrated by 97 in FIG. 44 may also be provided in all of the embodiments of the hair treating device disclosed hereinabove in place of the brush 13 or the like. While this form of spreading device does not give good results under some conditions as readily as the type using a brush, it is relatively fast and can be used to give satisfactory results not only on new growth at hair roots but also on the shafts of hair when treating liquids are to be applied thereto. The hair treating device illustrated in FIG. 44 is essentially the same as that of the embodiment illustrated in FIG. 10 except for the roller 97 instead of brush 13*e*. The parts have been given the same reference numerals except for the postscript letters and with this understanding the description given of FIG. 10 applies to FIG. 44 and need not be repeated.

Referring now to FIG. 45, the embodiment illustrated comprises a handle 200 of sufficient length to be grasped, a body 201 at an end of the handle having an elongated tip 204 extending laterally adjacent to and in the same direction as an elongated mounting area 212 for an elongated spreading device 205. The brush of FIG. 45, without the tip 204, is essentially the same as brushes used in bowl and brush method of the prior hair treating art referred to in the BCKGROUND OF THE INVENTION, but with the tip it becomes a new combination having significant advantages unknown and unobvious to the workers in it. The tip 204 may be molded integrally with the head 201 or be a separable piece capable of universal movement, or movement in a vertical or a horizontal plane, as described in connection with the embodiments illustrated in FIGS. 7 and 7*a*.

The device of FIG. 45 may be used in the same way as the device of FIG. 3 which has already been described, the principal difference being that the handle of FIG. 3 may be removed from the body 10 whereas in FIG. 45 the handle 200 is integral with the body 201. With the tip moved to the front or back to form a right angle with the direction of the brush 205, the device is useful for parting and painting the hair when a narrow ribbon stroke is desired by moving the brush transversely to the axis of the tip.

Referring now to FIG. 46, the embodiment of the invention illustrated in a blow molded squeeze bottle 220 having a tip 224 integrally molded in the wall thereof adjacent to the neck.

It has a liquid passageway 225 therethrough which can be closed for shipping, mixing and the like by an end plug 226.

Instead of molding the tip in the side wall of the bottle as just described, it may be made as a separate part of a container 230 as shown in FIG. 47. The tip 232 is provided at one end with a cylindrical enlargement 234 for securing it to the bottle in a manner similar to that described for the embodiments illustrated in FIGS. 7 and 7*a*. The tip 232 has a liquid passageway 236 extending from a funnel 238 in the cylinder 234 to a discharge orifice 238 near its free end. Means 240 integral with the wall of the bottle 230 adjacent to an orifice 242 holds the cylindrical end 234 of the tip 232 in pivotal relation to the bottle, permitting it to be placed along the wall of the bottle, as shwon in FIG. 47, which is advantageous for shipping, storage and the like. In this position the orifice 242 may be closed by the cylinder adjacent to the funnel 238, as shown, but when the tip 232 is raised to parting position the orifice 242 may communicate with the funnel 238 and passageway 236.

In the embodiments of FIGS. 46 and 47 where the tip is on the bottle, the spreading means will not ordinarily include a tip, although one may be provided to form a device having two tips, analogous to the embodiment of FIG. 30. The spreader illustrated in FIG. 47 comprises a body 244 adapted to make liquid tight connection to the bottle 230. An elongated spreading means 245 is secured to the body 244 so that its long dimension is in the same direction as tip 232 when it is raised to the square. The body 244 is provided with a liquid passageway 246 leading from the bottle to a manifold 247 connected to a plurality of discharge orifices 248. A bar 249 having an aperture 250 therein is slidably mounted in a recess in body 244 so that aperture 250 may be aligned with passageway 246 as shown, or it may be moved out of alignment to close passageway 246.

FIG. 48 discloses a further embodiment of a hair treatment device comprising a squeeze bottle 260 having a tip 261 formed therein, somewhat like the embodiment of FIG. 46, and with a spreading means similar to that shown in FIG. 47 except that the body 262 has a recess 263 in which a rotatable valve 264 is mounted. Valve 264 has a liquid passageway 265 therethrough which can be moved into and out of alignment with a discharge orifice 266 in the elongated mounting area 278 for the brush 277. Secured to valve 264 is an arm 279 carrying a closure plug 280 to stop flow of liquid through orifice 281 into the passageway in tip 261 when passageways 265 and 266 are aligned and to open orifice 281 when they are out of alignment.

FIG. 49 illustrates a further embodiment of the invention in which the tip is not integral with the body on which the spreading means is mounted. In this embodiment an annulus 292 is placed around the neck of a bottle 290 where it is firmly held by the body 291 which may carry any of the types of spreading means disclosed hereinabove. Annulus 292 has a tip 293 extending outwardly from its periphery, as shown, which, in use, is adjusted to extend in the same direction as the elongated spreading means.

FIG. 49 also shows an embodiment of spreading means in which the passage 294 from the squeeze bottle leads to a narrow slit 295 that dispenses a band or ribbon of the treating liquid. It is capable of spreading this band of liquid along a strand must more effectively than can be done from the tip of an applicator such as shown in FIG. 3 of the Levie U.S. Pat. No. 2,794,440 which has to be moved in a zigzag motion across and along the strand. This greater effectiveness is because the spreading means may be moved as a single stroke along the strand in a direction transverse to the long dimension of the slit to lay down a band of liquid as wide as the slit is long and as long as the stroke or movement along the strand. The operator can then work the liquid so dispensed into the hair in the same way as when the liquid is dispensed in the zigzag motion. This embodiment of the spreading means does not have the preferred penetrating means for carrying the liquid between the hairs of the strand as well as along it but it is a significant improvement over the prior art that has not been obvious to workers of ordinary skill in the art despite the long felt need for it. The shape of the slit as one looks into it may have any desired contour including straight, wavy, zigzag and the like, or a series of closely related dispensing passages such as shown in FIG. 47 which would constitute an interrupted slit but would function in essentially the same way and be within the scope of the word slit as used herein.

The embodiment of the invention illustrated in FIG. 50 is analogous to that shown in FIG. 49 except that the annulus 302 for the squeeze bottle 300 is elongated vertically, has a collar 303 at one end to make liquid tight contact with the neck 301 and a collor 304 at the other end corresponding to the neck of a squeeze bottle to make liquid tight contact with a spreading device. A tip 305 extends outwardly from annulus 302. Preferably it has a liquid passageway 306 extending through it. The spreading device 307, which makes liquid tight contact with collar 304 by means described above, has a liquid passageway 308 leading to a manifold 309 under the base 310 for an elongated brush 315. Base 310 is provided with a plurality of passageways 312 to deliver liquid from the manifold 309 to the mounting area at the base of brush 315.

The devices of FIGS. 47–50 may be used in the same manner as the devices of the other previously described embodiments of the invention to which they are most closely related structurally.

FIG. 51 discloses fragmentarily a collapsible tip mounted in a body 210 which comprises a plurality of frusto-conical hollow sections 214, 215, 216 and 217. Section 214 is secured in body 210 in any suitable way, e.g., by a screw connection. Section 215 has an external diameter at the large end slightly larger than the internal diameter of the smaller end of section 214. Section 216 has the same relation to section 215 that 215 has to 214. Section 217 has the same relation to section 216 that 216 has to 215. This permits the sections to be collapsed into 214 for shipping, storage and the like and to be extended as shown in FIG. 51 for use in the same way as other tips already set forth.

The parts of the hair treatment devices may be made of any suitable materials.

In general the molded plastic parts are preferably made from a plastic having some room temperature elasticity so that a mold part that has raised or depressed areas to form either depressions or projections on the surface formed against it can be pulled out without difficulty or damage to the molded structure and so that similarly shaped molded parts can likewise be assembled for use. Polyolefin plastics such as polyethylene, particularly high density polyethylene, and polypropylene plastics are quite suitable because they have the necessary elasticity and they are also resistant to chemical attack by the hair treating liquids with which the molded parts are to be used. Coloring materials may be added to such plastics to produce parts of almost any desired color. In the event that a transparent device is desired, rather than the opaque or translucent appearance obtained ordinarily with polyolefins, the device may be molded from ionomers which are cross linked polymers in which the linkages are ionic as well as covalent bonds, such as Surlyn A which is made of long chain branched olefins derived from ethylene ionized with carboxyl groups to provide the cationic portion of the cross links and with metal ions to provide the anionic portion. A similar plastic which is a copolymer of ethylene with small amounts of sodium methacrylate and methacrylic acid (Surlyn D) may also be used. Other suitable plastics include plasticized and modified polyvinyl chloride and ethyl vinyl acetate.

The bristles of a brush type spreading means may be natural bristle such as pig hair, horse hair, and the like, vegetable fibers or synthetic fibers of the type currently used for making brushes used in conjunction with hair treating liquids. Among synthetic fibers that may be used are olefin fibers such as oriented polypropylene, oriented nylon, and the like.

A roller type spreading means may be molded from the same types of plastics as the body of the device already mentioned above, although elasticity is not as essential for the roller as it is for the body. In general a grooved roller would be molded in a split mold that can be opened after the part is molded in it by moving the halves apart transversely to the axis of the roller far enough to clear the ridges before it is removed axially.

Spreaders in the form of rollers made of terry cloth, cotton and like materials having projections capable of penetrating between the hairs of a strand may be used instead of a brush or roller. Health codes may require that such spreaders be discarded after a single use because of the difficulty of sanitizing them. Rubber, plastic and fiber are preferable in most instances because they can be readily cleaned and sanitized after each use. Regardless of the materials used, the criterion for the preferred spreading means used is that it shall have some part or parts capable of penetrating between the hairs in the tress being treated so as to carry the liquid into the tress and not only pass along and apply the liquid to the surface of the tress.

Although the invention has been described and illustrated in connection with several specific embodiments, they are not to be taken as exclusive of other modifications and variations which are equally within the principles of the invention. In particular the embodiment illustrated in FIG. 3 is new and useful without liquid passageways, utilizing any form of handle fixed or removably secured to it for the operator to hold while using the tip 4 to form tresses and the brush 13 to spread liquid from any source into the hair. In this form it is essentially the same as the device of FIG. 45. This basic novel structure of FIGS. 3 and 45 is improved by making the tip movable with respect to the body and/or by the addition of a passageway for liquid from a squeeze bottle handle to a discharge orifice near the tip or to the discharge orifice in the mounting area, and still further improved by the provision of a passageway with branches to both discharge orifices or with a separate passageway to each, and with means for selectively directing the liquid to one or the other. Still further improvements are provided through valves having rinse connections, through an off position, through a pressure relief valve, through pressure or flow control plates, through contouring the tip, with or without tilting it relative to the axis of the collar from the usual right angular relation, to form a cradle for a tress of hair and through multi-compartment bottles and devices with plural tips and plural spreaders.

Improvements may also be provided in the brushes used with the hair treatment device. For example, the brush may have a tapered contour to a fine line at the very end, somewhat like a fine paint brush, to enable an operator to get close to the scalp with good control so as not to apply the liquid to the scalp by touching it with the brush. Such a shape may be obtained by providing bristles of different lengths, e.g., a center row of longer bristles and a row of shorter bristles at each side, or by cutting off the outside bristles on a suitable taper. A brush useful for graining the hair by not penetrating too deep into a strand may comprise tangled bristles leaving only short ends beyond the tangled area. Bristles may be tangled in manufacture or after manufacture by wiggling the brush against a surface so as to entwine or mat them together. The brush may apply bands or ribbons as wide as the long dimension or narrow streaks no wider than the short dimension at the ends of the bristles, depending upon the way the operator moves the brush along the hair. The movable tip enables the operator to point the tip at right angles to the direction the brush is to be moved so that, without rotating the handle in the operator's hand, the parting is made by movement in the direction of the axis of the tip and the brush stroke is made in the direction transverse to the direction of the axis of the tip, either as a broad band or a narrow streak.

Improvements in packaging and preparing hair treating mixtures for use in the hair treatment devices are made available through manipulatable, multi-compartment containers to ship reactive materials in the same package but separated from each other until time to mix them.

The various combinations of parts which are contemplated by the invention are as defined in the following claims.

I claim:

1. A hair treatment device comprising a thin wall plastic container adapted for mixing powdered bleach and liquid to form a paste by manipulation, said container including a single outlet secured to an annulus, a separate molded plastic body comprising a first part surrounding said container and engaging the adjacent surface of said annulus and a second part having a hollow tip with a passage there through for engaging the opposite surface of said annulus for discharging paste from said plastic container through said single outlet as a stream into and out of said hollow tip, and means connecting said thin wall container by means of said annulus in liquid tight relation to said molded plastic body.

2. A hair treatment device as set forth in claim 1 in which said separate molded plastic body includes a cylindrical attaching collar on said first part and said connecting means includes a neck removably connectable to said collar with said annulus between them.

3. A hair treatment device as set forth in claim 1 in which the second part of said separate molded plastic body includes at least one discharge orifice at the outer end of said passageway and spreading means adjacent thereto.

4. A hair treatment device as set forth in claim 3 in which said spreading means is a brush.

5. A hair treatment device as set forth in claim 3 in which the tip on said separate molded plastic body has a discharge orifice in the free end thereof.

6. A hair treatment device as set forth in claim 2 in which said said neck is part of a squeeze bottle.

7. A hair treatment device set forth in claim 2 in which said separate molded plastic body includes said cylindrical attaching collar and the passage in said body extends from a surface within said collar to an external surface on said tip.

8. A hair treatment device as set forth in claim 7 in which said body has spreading means on said external surface adjacent to said discharge orifice and said spreading means is a brush.

9. A hair treatment device comprising a squeeze bottle having a cylindrical neck and a cylindrical body portion of larger diameter than said neck, a thin wall plastic container in said bottle having an annulus surrounding an outlet from said container having a surface in contact with the free end of said neck, a body having thereon a single elongated tip and a liquid spreading means removably secured to the neck in liquid tight relation with said container by contact with an opposed surface of said annulus, liquid discharge means including a discharge passage from said container to at least one discharge orifice on the exterior of said body, and means to expel liquid contents from said container through a discharge orifice each time the bottle is squeezed until the contents of said container are substantially exhausted.

10. A hair treatment device as set forth in claim 9 in which said squeeze bottle is made in two separable parts joined in the cylindrical body portion adjacent to the region of said neck.

11. A hair treatment device comprising a thin wall plastic container adapted for mixing powdered bleach and liquid to form a paste by manipulation, said container including a single outlet secured to an annulus, a separate molded plastic body comprising a first part surrounding said container and engaging the adjacent surface of said annulus and a second part having a hollow tip with a passage way therethrough for engaging the opposite surface of said annulus for discharging paste from said plastic container through said single outlet as a stream into and out of said hollow tip, means connecting said thin wall container by means of said annulus in liquid tight relation to said molded plastic body, said separate molded plastic body including a cylindrical attaching collar on said second part and said connecting means including a neck removably connectable to said collar with said annulus between them, said neck being part of a squeeze bottle, and said squeeze bottle including a check valve for generating external air pressure on said thin walled plastic container by successive squeezes of said squeeze bottle.

12. A squeeze bottle comprising a cylindrical neck, a cylindrical body portion of larger diameter than said neck, a separable joint in said cylindrical body portion adjacent to the region of said neck, a bottom wall at the end of said body cylinder opposite said neck having an orifice therein, and a flap valve for closing said orifice when the bottle is squeezed and to open said orifice when squeezing pressure is released.

13. A package containing two hair treating materials that are reactive with each other but must be mixed just prior to use comprising a larger container of thin walled flexible material having an outlet orifice, an annulus surrounding said orifice and having liquid tight connection to said thin walled material, a dispensing cover closing said larger container by removable sealing connection to said annulus, a smaller container within said larger container of thin walled flexible material having no outlet, one of said hair treating materials being in said smaller container and the other in said larger container outside said smaller container, and a weekened area on said smaller container capable of being broken open to free its contents on squeezing pressure applied to said smaller container through said larger container.

* * * * *

UNITED STATES PATENT AND TRADEMARK OFFICE

CERTIFICATE OF CORRECTION

PATENT NO. : 4,209,027

DATED : June 24, 1980

INVENTOR(S) : SHILA MORGANROTH

It is certified that error appears in the above-identified patent and that said Letters Patent are hereby corrected as shown below:

Column 37, "that" is changed to --than-- in line 1.

Claim 1, line 8, "passage there through" is changed to --passageway therethrough--.

Claim 2, line 3, "first" is changed to --second--.

Signed and Sealed this

*Nineteenth* Day of *August 1980*

[SEAL]

*Attest:*

SIDNEY A. DIAMOND

*Attesting Officer*

*Commissioner of Patents and Trademarks*